US009856714B2

(12) United States Patent
Giroux

(10) Patent No.: US 9,856,714 B2
(45) Date of Patent: Jan. 2, 2018

(54) ZONE SELECT STAGE TOOL SYSTEM

(71) Applicant: Weatherford/Lamb, Inc., Houston, TX (US)

(72) Inventor: Richard L. Giroux, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 537 days.

(21) Appl. No.: 13/944,568

(22) Filed: Jul. 17, 2013

(65) Prior Publication Data

US 2015/0021026 A1 Jan. 22, 2015

(51) Int. Cl.

| | |
|---|---|
| ***E21B 33/14*** | (2006.01) |
| ***E21B 34/06*** | (2006.01) |
| *E21B 34/00* | (2006.01) |

(52) U.S. Cl.

CPC ..... *E21B 33/146* (2013.01); *E21B 34/063* (2013.01); *E21B 2034/007* (2013.01)

(58) Field of Classification Search

CPC ..... E21B 33/14; E21B 33/146

See application file for complete search history.

(56) References Cited

U.S. PATENT DOCUMENTS

| | | | |
|---|---|---|---|
| 3,768,556 | A | 10/1973 | Baker |
| 3,768,562 | A | 10/1973 | Baker |
| 4,312,406 | A | 1/1982 | McLaurin et al. |
| 4,421,165 | A | 12/1983 | Szarka |
| 4,479,545 | A | 10/1984 | Eley |
| 4,669,541 | A | 6/1987 | Bissonnette |
| 4,674,569 | A | 6/1987 | Revils et al. |
| 4,706,747 | A | 11/1987 | Schneider |
| 4,842,062 | A | 6/1989 | Schneider et al. |
| 4,869,323 | A | 9/1989 | Stagg |

(Continued)

FOREIGN PATENT DOCUMENTS

| | | | |
|---|---|---|---|
| EP | 0594390 | A2 | 4/1994 |
| EP | 1262629 | A1 | 12/2002 |

(Continued)

OTHER PUBLICATIONS

"Improving underreaming reliability with RFID technology," Originally appeared in World Oil Apr. 2012 issue, pp. 51-63.

(Continued)

*Primary Examiner* — Robert E Fuller

(74) *Attorney, Agent, or Firm* — Blank Rome LLP

(57) ABSTRACT

A stage tool operable with a plug is used for cementing a tubing string in a wellbore annulus. The tool can have a housing with a closure sleeve movably disposed in the internal bore of the housing. When pressure is applied downhole to the tool, a breachable obstruction on an exit port of the tool's bore opens and allows fluid such as cement slurry to communicate to the wellbore annulus. When cementing through the open tool is finished, a plug can be deployed downhole lands on a seat in the closure sleeve, and applied fluid pressure in the tool's bore against the seated plug closes the closure sleeve relative to the housing's exit port. Rotational catches between the housing's bore and the closure sleeve prevent the closure sleeve from rotating. A hydraulic mechanism on the tool can facilitate movement of the closure sleeve in response to a fluid pressure component.

33 Claims, 23 Drawing Sheets

(56) References Cited

U.S. PATENT DOCUMENTS

| | | | | |
|---|---|---|---|---|
| 4,880,058 | A | 11/1989 | Lindsey et al. | |
| 4,941,535 | A * | 7/1990 | Porter | E21B 29/00 166/169 |
| 4,979,562 | A | 12/1990 | Langer | |
| 5,024,273 | A | 6/1991 | Coone et al. | |
| 5,038,862 | A | 8/1991 | Giroux et al. | |
| 5,109,925 | A | 5/1992 | Stepp et al. | |
| 5,137,087 | A | 8/1992 | Szarka et al. | |
| 5,314,015 | A | 5/1994 | Streich et al. | |
| 5,368,098 | A | 11/1994 | Blizzard, Jr. et al. | |
| 5,411,095 | A | 5/1995 | Ehlinger et al. | |
| 5,464,062 | A | 11/1995 | Blizzard, Jr. | |
| 5,526,878 | A | 6/1996 | Duell et al. | |
| 5,738,171 | A | 4/1998 | Szarka | |
| 6,095,247 | A | 8/2000 | Streich et al. | |
| 6,513,595 | B1 | 2/2003 | Freiheit et al. | |
| 6,695,057 | B2 | 2/2004 | Ingram et al. | |
| 7,311,148 | B2 | 12/2007 | Giroux et al. | |
| 7,334,650 | B2 | 2/2008 | Giroux et al. | |
| 7,798,225 | B2 | 9/2010 | Giroux et al. | |
| 7,857,052 | B2 | 12/2010 | Giroux et al. | |
| 2002/0174986 | A1 * | 11/2002 | Szarka | 166/289 |
| 2003/0019630 | A1 | 1/2003 | Freiheit et al. | |
| 2004/0245020 | A1 | 12/2004 | Giroux et al. | |
| 2007/0029082 | A1 | 2/2007 | Giroux et al. | |
| 2007/0261850 | A1 | 11/2007 | Giroux et al. | |
| 2009/0151960 | A1 | 6/2009 | Rogers et al. | |
| 2009/0266544 | A1 | 10/2009 | Redlinger et al. | |
| 2011/0079381 | A1 | 4/2011 | Cejero et al. | |
| 2012/0205091 | A1 | 8/2012 | Turley et al. | |
| 2012/0247767 | A1 | 10/2012 | Themig et al. | |
| 2012/0267119 | A1 * | 10/2012 | Patel | 166/373 |

FOREIGN PATENT DOCUMENTS

| | | |
|---|---|---|
| WO | 2007/134255 | 11/2007 |
| WO | 2010054407 | 5/2010 |
| WO | 2012/162792 A1 | 12/2012 |

OTHER PUBLICATIONS

"Rooted in Technology" Weatherford Magazine, Mar. 2013, vol. 15, No. 1, 40 pages.

"RipTide Drilling Reamer," Weatherford, obtained from weatherford.com, Copyright 2004-2012, brochure No. 7038.03, 12 pages.

First Examination Report in counterpart Australian Appl. 2014204481, dated Jun. 21, 2015.

First Office Action in counterpart Canadian Appl. 2,857,381, dated Nov. 17, 2015.

Weatherford, "Inflatable Products and Accessories," obtained from weatherford.com, (c) 2008-2012, brochure No. 612.02, 96 pages.

Weatherford, "Real Results: PEMEX Reforma Saves 14 Days Cementing Through Lost-Circulation Zone with Hydraulic Stage Tool," obtained from weatherford.com, (c) 2006, Real Result RR4364.00, 1 page.

Weatherford, "Eliminator Series Stage Tools: Models 751E, 752E, 751PD and 752PD," (obtained from weatherford.com, (c) 2008, brochure 75.04, 5 pages.

Weatherford, "Hydraulic Stage Tool: Model 754PD with Casing Plug Set," obtained from weatherford.com, (c) 2008-2012, brochure No. 76.05, 4 pages.

Weatherford, "Real Results: ACP Packer and Hydraulic Stage Tool Achieve Critical Liner Cementation in Geothermal Well," (c) 2008-2010, brochure No. 6197.01, 1 page.

Davis-Lynch, LLC, "Equipment Catalog No. 20" www.davis-lynch.com, 32 pages.

Halliburton, "Cementing: ES II Stage Cementer" brochure No. H06737 Feb. 2009, www.halliburton.com, (c) 2009, 2 pages.

Halliburton, "FO Multiple-Stage Cementing System," brochure No. H09046 Mar. 2012, www.halliburton.com, (c) 2012, 2 pages.

Halliburton, "Multiple-Stage Cementing Equipment," brochure No. H06940 Jun. 2009, www.halliburton.com, (c) 2009, 2 pages.

Schlumberger, "KickStart: Rupture disc valve," (c) 2012, www.slb.com/mss, 2 pages.

TAM International, "TAM Port Collars for Selective: Stage Cementing, Producing,Treating, Testing," ISO 9001:2008, www.tamintl.com, 4 pages.

Weatherford, "Inflatable Packer Products," Dan Chambers, Oct. 22, 2009, (c) 2005, 64 pages.

Schoenfeld, Jason, "Using Burst Collars in a Liner String for Multi-zone Completions in Horizontal Wellbores: Case Study," SPE International, SPE 134533, Sep. 2010, 8 pages.

Davis-Lynch, LLC, "Davis Stage Cementing Collars and Equipment," 5 pages.

Trican Well Service, "BPS (Burst Port System): The Ideal Solution for Multi-Stage Stimulation of Horizontal Wells," www.trican.ca, CA31.500.10/10, 2 pages.

Extended Search Report in counterpart EP Appl. 14 177 555.1, dated Jul. 22, 2017.

Second Office Action in counterpart Canadian Appl. 2,857,381, dated Sep. 22, 2016.

* cited by examiner 100
150
170
176
166
116a
136
130
114
115
140
146
116c
180

100
150
170
140
114
130
180

100
128,148b
140
134a
138,148a
114
130
134b
116b
136
135
70
72
165b
174
170
165a
150
156
152
188
186
180
155

100
140
114
130
165b
174
170
165a
150
156
155
180

ZONE SELECT STAGE TOOL SYSTEM

BACKGROUND OF THE DISCLOSURE

Cementing operations are used in wellbores to fill the annular space between casing and the formation with cement. When this is done, the cement sets the casing in the wellbore and helps isolate production zones at different depths within the wellbore from one another. Currently, the cement use during the operation can flow into the annulus from the bottom of the casing (e.g., cementing the long way) or from the top of the casing (e.g., reverse cementing).

Due to weak earth formations or long strings of casing, cementing from the top or bottom of the casing may be undesirable or ineffective. For example, when circulating cement into the annulus from the bottom of the casing, problems may be encountered because a weak earth formation will not support the cement as the cement on the outside of the annulus rises. As a result, the cement may flow into the formation rather than up the casing annulus. When cementing from the top of the casing, it is often difficult to ensure the entire annulus is cemented.

For these reasons, staged cementing operations can be performed in which different sections or stages of the wellbore's annulus are filled with cement. To do such staged operations, various stage tools can be disposed on the casing string for circulating cement slurry pumped down the casing string into the wellbore annulus at particular locations.

For example, FIG. 1A illustrates an assembly according to the prior art having a stage tool 24 and a packer 22 on a casing string 20, liner, or the like disposed in a wellbore 10. The stage tool 24 allows the casing string 20 to be cemented in the wellbore 10 using two or more stages. In this way, the stage tool 24 and staged cementation operations can be used for zones in the wellbore 10 experiencing lost circulation, water pressure, low formation pressure, and high-pressure gas.

As shown, an annulus casing packer 22 can be run in conjunction with the stage tool 24 to assist cementing of the casing string 20 in the two or more stages. The stage tool 24 is typically run above the packer 22, allowing the lower zones of the wellbore 10 to remain uncemented and to prevent cement from falling downhole. One type of suitable packer 22 is Weatherford's BULLDOG ACP™ annulus casing packer. (ACP is registered trademarks of Weatherford/Lamb, Inc.)

Other than in a vertical bore, stage tools can be used in other implementations. For example, FIG. 1B illustrates a casing string 20 having a stage tool 24 and a packer 20 disposed in a deviated wellbore. As also shown, the assembly can have a slotted screen below the packer 22.

A. Stage Cementing Tools

Various types of stage tools are known and used in the art. In general, the stage tools can be operated hydraulically or mechanically. A mechanical stage tool is opened and closed mechanically and typically has a unitary sleeve that offers greater wall thickness, reduced internal diameter, and superior strength. A hydraulic stage tool uses a seat to engage a plug, which is then used to open the tool with the application of pressure. The seat is typically composed of aluminum or other comparable material so the seat can be readily drilled out after use. Because such a stage tool is hydraulically operated, the casing can be run in highly deviated wells where mechanical operation could be difficult.

1. Prior Art Hydraulically-Operated Stage Tool

As one particular example, FIG. 2A illustrates a hydraulically-operated stage tool 30 according to the prior art in partial cross-section. This stage tool 30 is similar to Weatherford's Model 754PD stage tool. The tool 30 is run on the casing string (not shown) and includes a housing 32 having an internal bore 34. A port 36 on the side of the housing 32 can communicate the bore 34 with the wellbore annulus (not shown) depending on the locations of an opening sleeve 40 and a closing sleeve 50.

Plugs, such as a first stage plug 60 (FIG. 2B) and a closing plug 70 (FIG. 2C), are used in a cementing system to close off the casing, to open the stage tool 30 (by opening the opening sleeve 40), and to close the stage tool 30 (by closing the closing sleeve 50). Further downhole, a landing seat 65 (FIG. 2C) is placed in an area of a casing collar (not shown) between two pin threads near the bottom of the casing to close off the casing by engaging the first stage plug 60.

In particular, during cementing operations, the first stage plug (60: FIG. 2B) is launched through the casing following the first stage of cement pumped downhole. Reaching the closed stage tool 30 as shown in FIG. 3A, the plug (60) passes through the opening sleeve 40 in the stage tool 30 and travels to the landing seat 65 (FIG. 2B) installed further downhole. Reaching the seat (65), the plug (60) then closes off the casing to make it a closed chamber system.

With plug 60 landed, increased internal casing pressure hydraulically opens the stage tool 30 by allowing the opening sleeve 40 to shift down and expose the tool's ports 36, thus enabling circulation and then second-stage cement to pass through the port 36 into the annulus above the tool 30. To do this, pressure is applied to the closed chamber system due to the seated plug (60). The pressure in the casing acts on the differential area of the opening sleeve 40 and eventually breaks the shear pins 42 holding the opening sleeve 40 in place. The stage tool 30 can be equipped with field-adjustable shear pins 42, enabling operators to choose opening pressures suitable for specific well requirements. Additionally, the profile on the closing sleeve 40 can be used to catch a free-fall opening plug (not shown) deployed down the casing if the first stage plug (60) does not make the casing a closed chamber system.

When the shear pins 42 break, the opening sleeve 40 then shifts down, opening fluid communication through the port 36 in the stage tool 30 to the surrounding annulus (not shown). The opening sleeve 40 is stopped when it reaches its lower limit of travel. At this point, cement pumped downhole is communicated out of the tool 30 through the open ports 36 so a second stage cement job can be done.

When cementing the second stage nears completion, a closing plug 70 (FIG. 2C) is released and wipes the casing ID clean of cement until it lands on the closing sleeve 50, as shown in FIG. 3C. Increased pressure shifts the closing sleeve 50 downward, releasing locking lugs and allowing the sleeve body 54 to move down across the ports 36, closing the tool 30. In particular, fluid pressure supplied behind the closing plug 70 shears the shear pins 52, allowing the closing sleeve 50 to shift down and release a locking ring 56. The sleeve 50 then engages against a shoulder of the sleeve body 54 so that the fluid pressure applied against the seated plug 70 moves the sleeve body 54 to close off the ports 36. A snap ring can lock the sleeve 50 in position, ensuring the stage tool 30 remains locked. Eventually, the plugs 60 and 70 and seats can be milled/drilled out so that the stage tool 30 has an inner diameter consistent with the casing's inner diameter.

2. Other Prior Art Hydraulically-Operated Stage Tool

In another example of FIGS. 4A-4C, another hydraulically-operated stage tool 30 according to the prior art shown in partial cross-section is illustrated during steps of operation. The stage tool 30 is similar to a Type 777 HY Hydraulic-Opening Stage Cementing Collar available from Davis Lynch. The stage tool 30 runs on a casing string (not shown) and has a housing 32 with an internal bore 34.

The stage collar 30 has an opening sleeve 40 that is manipulated hydraulically. To move the opening sleeve 40 to the opened position as shown in FIG. 4B, pressure is applied against a landed first-stage plug (not shown). The applied pressure breaks a lower set of shear balls 42, which allows the opening sleeve 40 to shift downward and uncover the tool's ports 36. At this point, cement slurry can be pumped downhole and pumped into the wellbore annulus through the open ports 36.

To close the tool 30, a closing plug 70 as shown in FIG. 4C lands on a closing sleeve 50 inside the tool 30. When pressure is applied, an upper set of shear balls 52 is broken, and the closing sleeve 50 shifts downward so that the sleeve body 54 closes off the ports 36. Eventually, the plugs and seats can be milled/drilled out so that the stage tool 30 has an inner diameter consistent with the casing's inner diameter.

3. Tubing-Manipulated Stage Tool

In FIGS. 5A-5C, yet another stage tool 30 according to the prior art is shown in partial cross-section. This stage tool 30 is similar to a stage tool available from Packers Plus Energy Services, Inc., as disclosed in US Pat. Pub. 2012/0247767. The stage tool 30 is run into and set in the wellbore 10 in a closed condition (FIG. 5A) and is manipulated hydraulically to an opened condition (FIG. 5B) for stage cementing by application of casing pressure to shift an opening sleeve 40 up. After the introduction of cement, the tool 30 may be manipulated mechanically by lowering the casing string down to a closed condition (FIG. 5C) to close off communication between the annulus and the inner bore 32 of the tool 30.

The tool 30 has an upper housing 34 that fits inside a lower housing 35. The upper housing 34 has a bore 32 therethrough as does the lower housing 35. Ports 36 in the upper housing 34 can communicate the bore 32 outside the tool 30 depending on how the tool 30 is manipulated. In the closed condition shown in FIG. 5A, for example, the tool's ports 36 are closed by a movable closure 40, which covers the ports 36 and is releasably set in a closed position by shear pins 42. Meanwhile, the housings 34, 35 are retracted from blocking the ports 36.

Once the tool 30 is in position, the ports 36 are opened as shown in FIG. 5B to provide fluid communication from the inner bore 32 to the wellbore annulus 14. To open the ports 36, fluid pressure communicated to the tool's bore 32 acts against a piston face 46 of the movable closure 40. Once fluid pressure is increased to a sufficient level to overcome the strength of the shear pins 42, the closure 40 moves away from its closed position over the ports 36. To facilitate and enhance movement, the closure 40 can also be driven by a spring 48.

Cement is then introduced to the inner bore 32 and flows out through the open ports 36 into the annulus 14. During cementing operations, the housings 34 and 35 are held in tension by support of the string above the tool 30. When sufficient cement has been introduced, the ports 36 are closed.

To close the ports 36, the stage tool 30 is compressed to bring the overlapping lengths of the housings 34, 35 to a position covering the ports 36. To do this, the tubing string can be lowered from the surface to drive the housings 34 and 35 telescopically together into greater overlapping relation. The sliding movement continues until the overlapping region covers the ports 36 and a seal 38 passes over and seals the ports 36 from the annulus, as shown in FIG. 5C. With the fluid flow blocked through ports 36, the cement is held in the annulus where it can set over time.

If desired, a backup closing sleeve 39 may be carried by the tool 30 to act as a backup seal against fluid leakage after the tool 30 is collapsed and closed. For example, the sleeve 39 can be positioned and sized to close both the interface between the housings 34, 35 and the ports 36, which are the two paths through which leaks may occur. The backup sleeve 39 may be moved along the bore 32 by engagement with a pulling tool (not shown).

B. Issues with Current Stage Tools

In development wells with a high bend radius (e.g., typically 10 to 15° per hundred feet of drilled hole), opening and closing a standard hydraulically-operated stage tool can be problematic, especially when the tool is located in the bend radius after placement (landing) of the casing. Some stage tools may experience problems with opening, closing, or both in such an instance.

For example, when an opening sleeve in a stage tool is short and is fully contained on a concentric closing sleeve, the opening sleeve may be easy to open. If the opening sleeve is partially on a closing sleeve and another component, the sleeve has to shift down on two surfaces of components that may not be concentric. When the stage tool is in a bend radius in such a situation, one of these components of the tool may have more stiffness than another so the alignment of the surfaces can be skewed and cause problems during opening.

Closing a stage tool can be less problematic when a short closing sleeve is shifted to cover the ports. Yet, a closing sleeve that covers anti-rotation slots and ports may have added overall length, and the increased contact area can hinder the sleeve's movement, especially when the tool is used in a bend radius.

Regardless of opening and closing issues, stage tools may be susceptible to burst and collapse during cementing operations. A short closing sleeve may make the tool less susceptible to collapse, while a long closing sleeve and use of anti-rotation slots can significantly increase the tool's susceptibility to collapse. However, any of the various stage tools can have a significant amount of the tool's case exposed to burst pressure after the inside of the tool is drilled out.

Additionally, hydraulically-operated stage tools can have lower collapse and/or burst pressure ratings than desired especially for certain development wells. In particular, a development well may require stage tools to have a higher burst pressure rating than usual because the development well needs to be hydraulically fractured at high rates and high pressures after the well is completed. Therefore, stage tools in the 4.50", 5.50", 7", 8⅝", and 9⅝" sizes may need to be rated to a minimum burst and collapse pressures comparable to P-110 or higher grade (e.g., Q125 or V150) pipe. Notably, the casing sizes listed are used as production casing, which can be exposed to frac fluid pressures.

Although mechanical port collars may be effective at high pressure ratings, operators in development wells prefer using hydraulically-operated stage tools for wellbore cementing because mechanical port collars require too much time to rig up the running tools needed to operate the port collar. Additionally, any stage tool that is closed using pipe manipulation, such as discussed above, may not be useable in some implementations because the pipe cannot be manipulated to close the stage tool.

For this reason, the subject matter of the present disclosure is directed to overcoming, or at least reducing the effects of, one or more of the problems set forth above.

SUMMARY OF THE DISCLOSURE

In one arrangement, a stage tool is used in a method for cementing casing in a wellbore annulus. The stage tool has a housing that disposes on the casing string and has a first or closure sleeve disposed in the housing's internal bore. The housing has an exit port that communicates the housing's internal bore with the wellbore annulus. When deployed, the exit port has a breachable obstruction, such as a rupture disc or other temporary closure, preventing fluid communication through the exit port. In response to a first fluid pressure component in the housing's bore, however, the breachable obstruction opens fluid communication through the exit port so fluid can communicate from the tool into the wellbore annulus.

In one example, an opening plug or the like can be deployed down the casing string to close off fluid communication downhole of the stage tool, and fluid pressure can be exerted down the casing string. The breachable obstruction can be a rupture disc disposed in the exit port of the housing, and the rupture disc can rupture, break, split, divide, tear, burst, etc. in response to a pressure differential across it due to the fluid pressure in the housing's bore relative to the wellbore annulus. Thus, while the closure sleeve is in an opened condition, fluid pressure during a cementing operation can be applied downhole to the tool, and the breachable obstruction on the tool's exit can open and allow fluid such as cement slurry to communicate to the wellbore annulus.

For its part, the closure sleeve is movably disposed in the first internal bore at least from an initial position to a closed position relative to the exit port. In this way, when cementing through the open tool finishes, a plug deployed downhole can land on a seat in the closure sleeve, and applied fluid pressure in the tool's bore against the seated plug can close the closure sleeve relative to the housing's exit port. In other arrangements, a secondary closure mechanism on the tool can move the closure sleeve from the initial condition to the closed condition. The secondary closure mechanism can be used in addition to the seated plug or can be used instead of the seated plug.

The housing and closure sleeve have rotational catches that restrict rotation of the first sleeve in the closed position in the housing's bore. For example, the rotational catch for the housing can include a plurality of castellations disposed about an internal shoulder in the housing's bore, and the rotational catch for the closure sleeve and include a plurality of castellations disposed on an end of the closure sleeve.

The closure sleeve can include various features, such as seals disposed externally on the sleeve to sealably engage in the housing's bore of the housing. When the closure sleeve is in the closed position, these seals can seal off the exit port on the housing. The closure sleeve can also use a lock ring disposed externally on the sleeve. The lock ring can engage in internal grooves defined in the housing's bore when the first sleeve is in the initial and closed positions.

Preferably, a second or intermediate sleeve is used in the housing's bore and has rotational catches on each end. When the closure sleeve moves closed, the intermediate sleeve is also moved to engage between the catches on the end of the closure sleeve and the catches on a shoulder of the housing's bore. The intermediate sleeve helps maintain an overall wall thickness of the tool and can be useful during opening or closing of the tool when the tool disposes in a heel of a vertical section of a deviated wellbore. Additionally, the intermediate sleeve can cover a sealing area in the housing's internal bore from flow before the closure sleeve is moved closed to seal against that protected area.

In some arrangements as noted above, a secondary closure mechanism on the tool can move the closure sleeve in response to a fluid pressure component. Depending on the particular implementation and the cementing operation, the closure mechanism can be used alone or in conjunction with a seated plug to move the closure sleeve closed.

In one example, the closure mechanism can include a piston disposed in a chamber of the housing. The piston moves in the chamber in response to a pressure differential from a fluid pressure component applied across the piston between first and second portions of the chamber. In particular, the piston can seal a low pressure in the first portion of the chamber, and the piston can have an inlet port communicating the second portion of the chamber with the housing's internal bore. This inlet port can have a breachable obstruction, such as a knock-off pin, preventing fluid communication through the internal port.

When the breachable obstruction is broken away, ruptured, or the like by a passing plug or wiper, then fluid pressure in the housing's bore can enter the second portion of the chamber through the open inlet port. In turn, the buildup of pressure in the second portion of the chamber can cause the piston to move and close the closure sleeve.

Rather than having the inlet port exposed to the housing's bore, the inlet port of the piston's camber can communicate the second portion of the chamber with the wellbore annulus. A valve can be operable to prevent and allow fluid communication through the inlet port so as to move the piston. The valve can include a breachable obstruction, such as a rupture disc, that can be opened with a solenoid or the like. In response to a particular activation signal, such as from a radio frequency identification tag, a pressure pulse, etc., the valve can open fluid communication of the inlet so that a buildup of pressure in the second portion of the chamber can move the piston and close the closure sleeve.

The foregoing summary is not intended to summarize each potential embodiment or every aspect of the present disclosure.

DETAILED DESCRIPTION OF THE DISCLOSURE

A. First Embodiment of Hydraulically-Operated Stage Tool

Figure 1A:
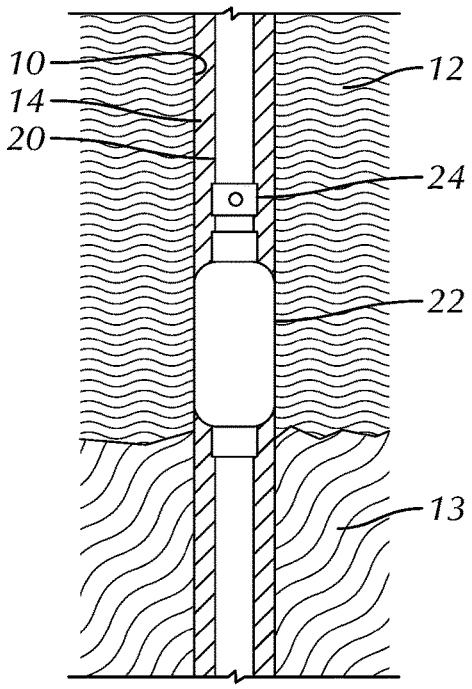
FIG. 1A (Prior Art)
FIG. 1A illustrates an assembly according to the prior art having a stage tool and a packer disposed in a vertical wellbore.
Figure 1B:
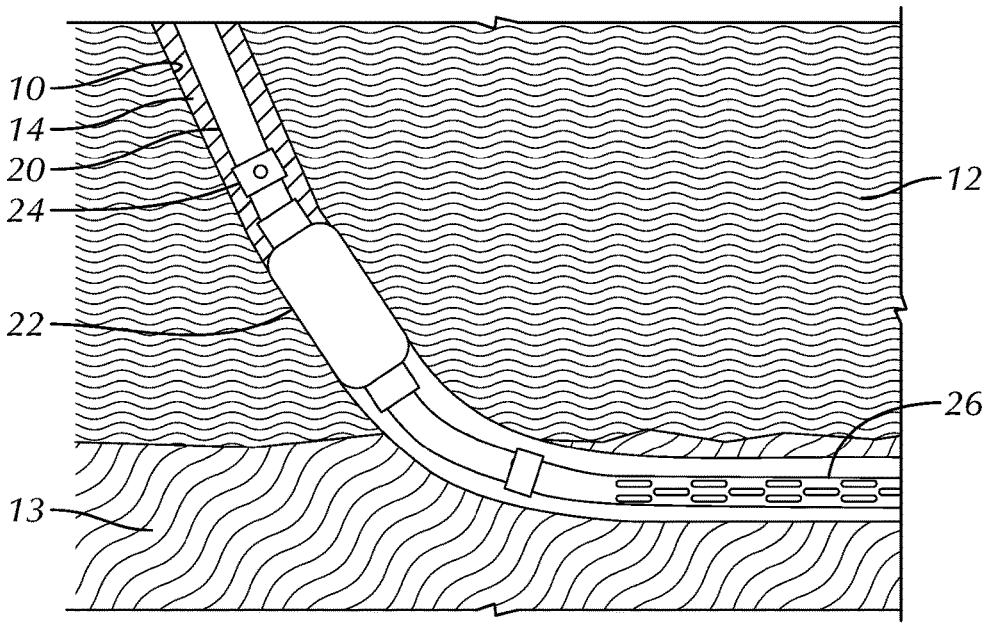
FIG. 1B (Prior Art)
FIG. 1B illustrates an assembly according to the prior art having a stage tool and a packer disposed in a deviated wellbore.
Figure 6A:
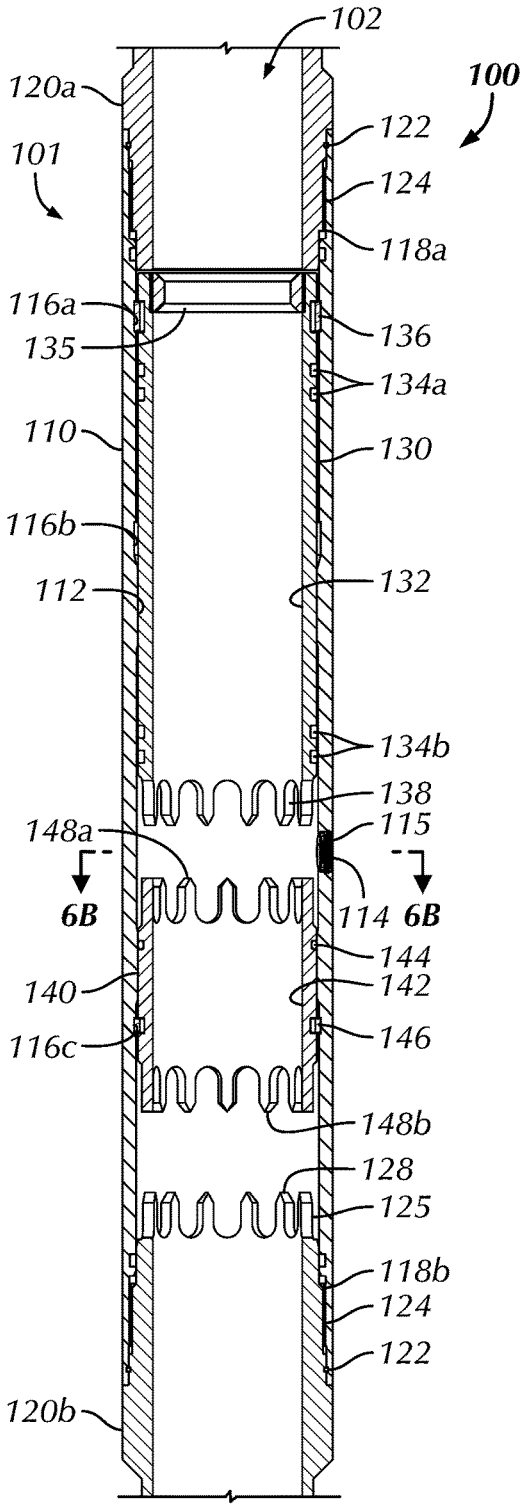
FIGS. 6A-6B illustrate a first embodiment of a hydraulically-operated stage tool according to the present disclosure in cross-sectional and end-sectional views.
Figure 6B:
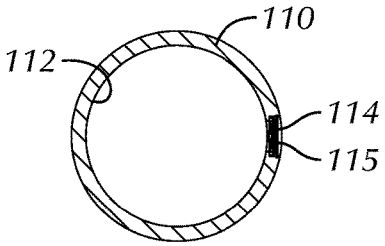

FIGS. 6A-6B illustrate a first embodiment of a hydraulically-operated stage tool 100 according to the present disclosure in cross-sectional and end-sectional views. The stage tool 100 is hydraulically-operated with plugs and is well-suited for deviated wells. As noted previously, the stage tool 100 can be used in conjunction with a packer (see e.g., FIGS. 1A-1B), although it may be used in any other configuration.

The stage tool 100 includes a housing 101 with an internal bore 102 therethrough. For assembly purposes, the housing 101 can include separate components of a tool case 110 having upper and lower subs 120*a-b* affixed on the case's ends 118*a-b*. The upper sub 120*a* can be a box sub for connecting to an uphole portion of a casing string (not shown), and the lower sub 120*b* can be a pin sub for connecting to a downhole portion of the casing string, a packer, or the like (not shown) depending on the assembly.

Shear screws, welds, tack welds, and the like can be used at the connections between the casing 110 and the subs 120*a-b*. As shown in FIG. 6A, locking wires 122 can be used at the connections between the case 110 and the subs 120*a-b* instead of shear screws. This allows the case 110 to be torqued to a maximum torque allowed for the threads 124 before the tool 110 is taken to a well location or while the tool 100 is at the well location. Operators may find this tight fit useful when the stage tool 100 is to be used in a deviated borehole having a high bend radius. Moreover, the stage tool 100 may be constructed to handle large burst pressures by using high yield strength materials and by increasing the outside dimension of the tool 100.

Two sleeves 130 and 140 are disposed in the tool's housing 101. The first sleeve 130 is a closing sleeve movable from an initial run-in position (FIG. 6A) toward a closed position (discussed below). A closing seat 135 is disposed in the inner passage 132 of this closing sleeve 130, and a combination detent/lock ring 136 and seals 134*a-b* are disposed on the exterior of this closing sleeve 130.

The second sleeve 140 is a protective sleeve disposed a distance downhole from the closing sleeve 130 in the housing's bore 102. The protective sleeve 140 similarly has two positions, including an initial, run-in position (FIG. 6A) and a sandwiched position (discussed below). In the run-in position shown, the protective sleeve 140 has an outer detent ring 146 that can engage in a corresponding groove 116*c* on the inside surface of the case's bore 112. An external seal 144 may also be provided on the exterior surface of the protective sleeve 140.

In the space between the ends of the closing sleeve 130 and the protective sleeve 140, the housing 101 (i.e., the case 110) defines one or more exit ports 114 for fluid communication out of the housing's bore 102 to a surrounding wellbore annulus (not shown). One exit port 114 is shown, but others could be provided if desired. A breachable obstruction 115, such as a burst disc, a rupture disc, a burst diaphragm, a rupture plate, a plug, or other temporary closure, is disposed in the exit port 114 and can be affixed in place by a retaining ring, threading, tack weld, screws, or other feature.

During use, opening the stage tool 100 uses the breachable obstruction or rupture disc 115 installed in the exit port 114 of the tool 100 to open flow of fluid out of the tool 100 to the surrounding wellbore annulus. A pressure differential is required to rupture the disc 115 and can be preconfigured and selected as needed in the field. This allows the opening pressure for the tool 100 to be selected by operators. As will be appreciated, being able to select an opening pressure for the tool 100 may be beneficial for some implementations where other equipment downhole from the stage tool 100 are set by internal casing pressures—e.g., inflatable and/or compression packers, etc. Overall, use of the breachable obstruction 115 eliminates the need for an opening sliding sleeve inside the tool 100 and reduces the amount of material that needs to be drilled out after cementing operations are completed.

Figure 2:
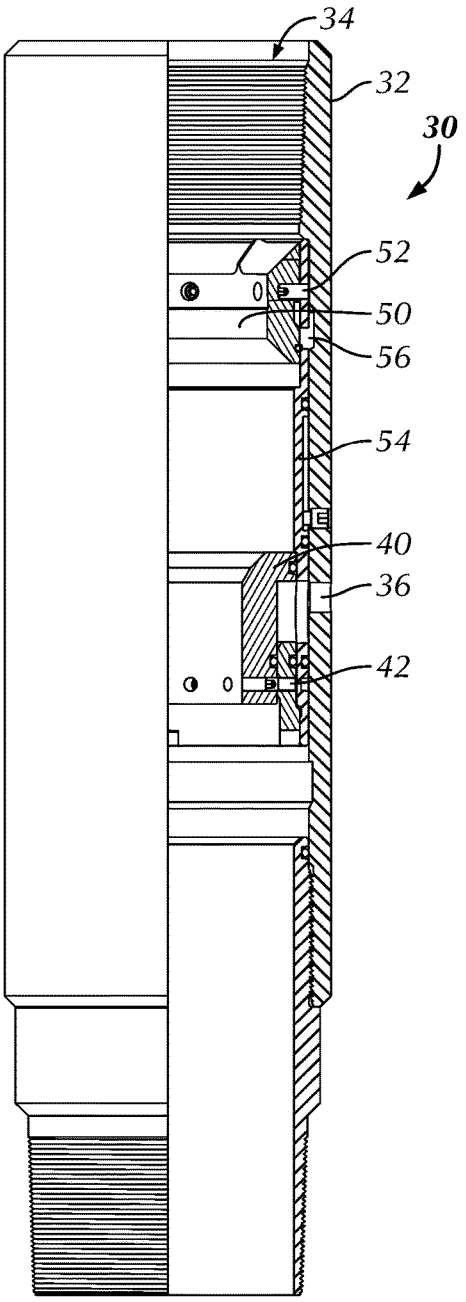
FIG. 2 (Prior Art)
FIGS. 10D-1 and 10D-2 illustrate alternative electronic valve systems for the secondary closure mechanism of the third tool.
Figure 2B:
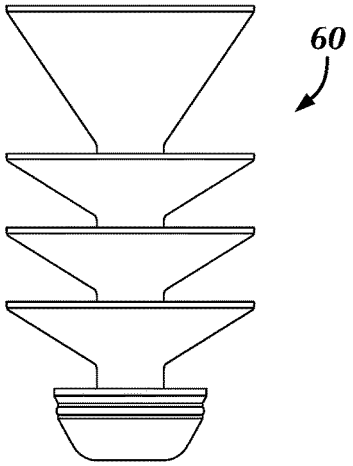
FIG. 2B (Prior Art)
FIG. 2B illustrates a wiper and seat according to the prior art.
Figure 2C:
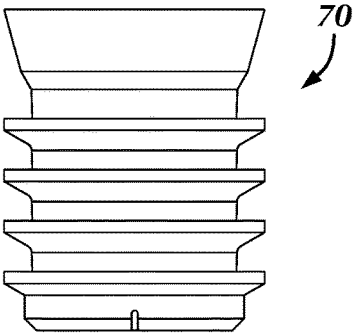
FIG. 2C (Prior Art)
FIG. 2C illustrates a plug according to the prior art.
Figure 2D:
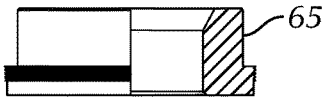
FIG. 2D (Prior Art)
FIG. 2A illustrates a hydraulically-operated stage tool according to the prior art in partial cross-section.
Figure 3A:
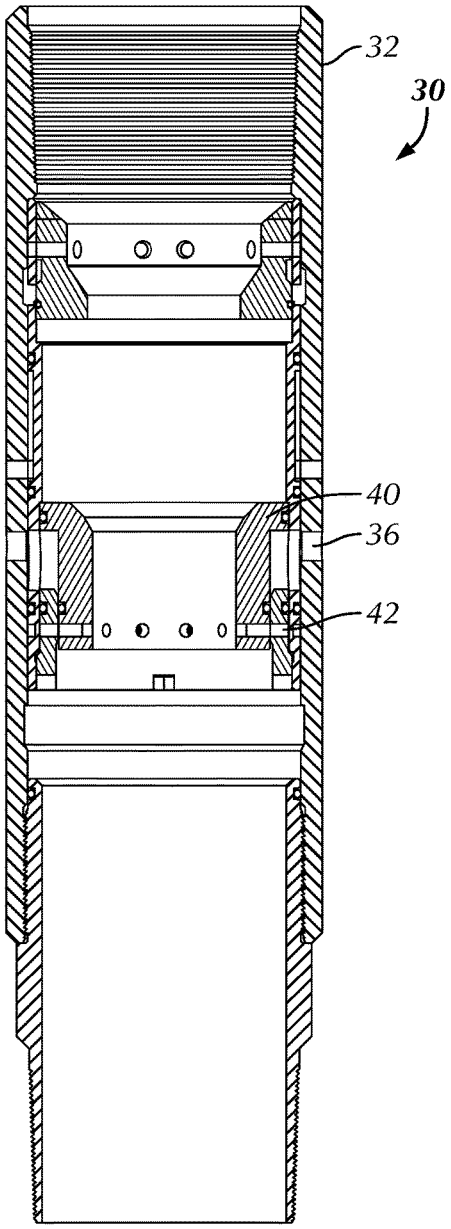
FIG. 3A (Prior Art)
FIGS. 3A-3C illustrate operation of the stage tool of FIG. 2A.
Figure 3B:
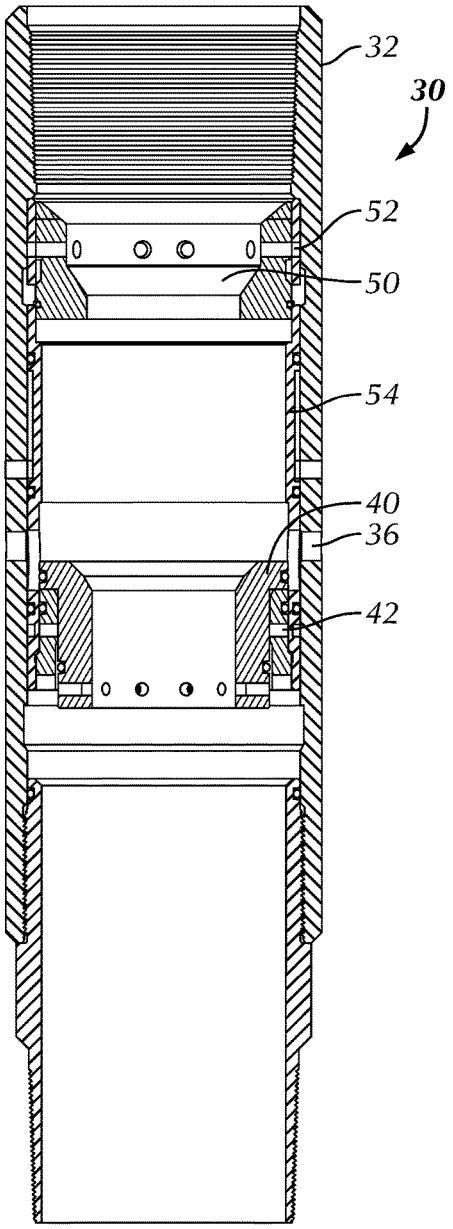
FIG. 3B (Prior Art)
Figure 3C:
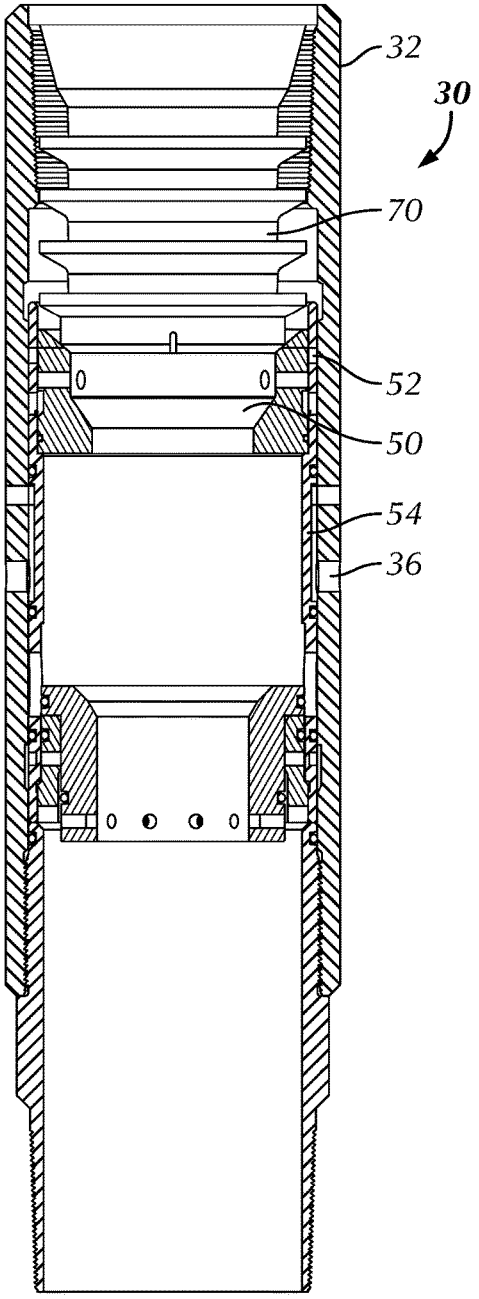
FIG. 3C (Prior Art)
Figure 4A:
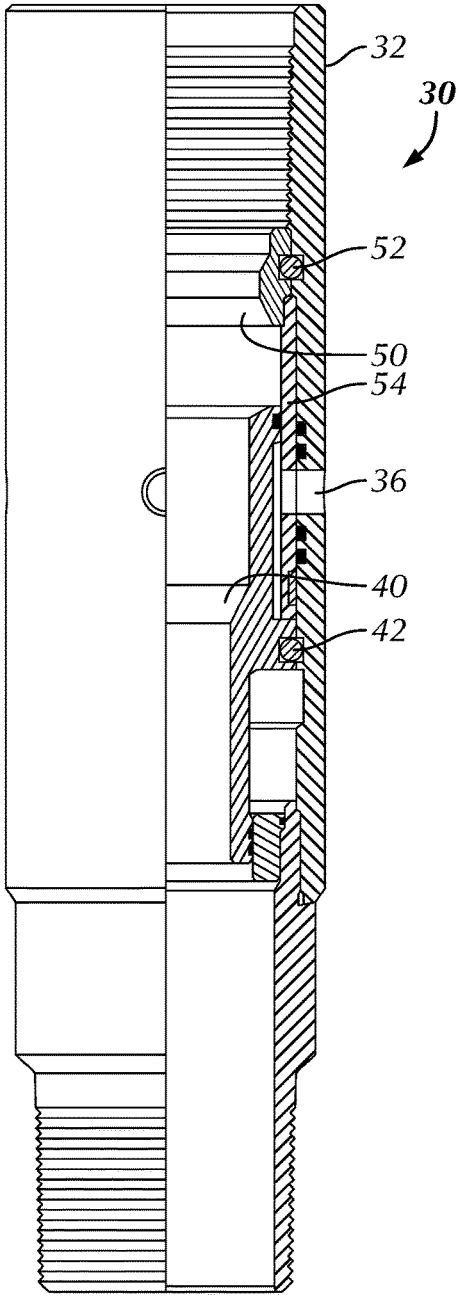
FIG. 4A (Prior Art)
FIGS. 4A-4C illustrate another hydraulically-operated stage tool according to the prior art in partial cross-section during operational steps.
Figure 4B:
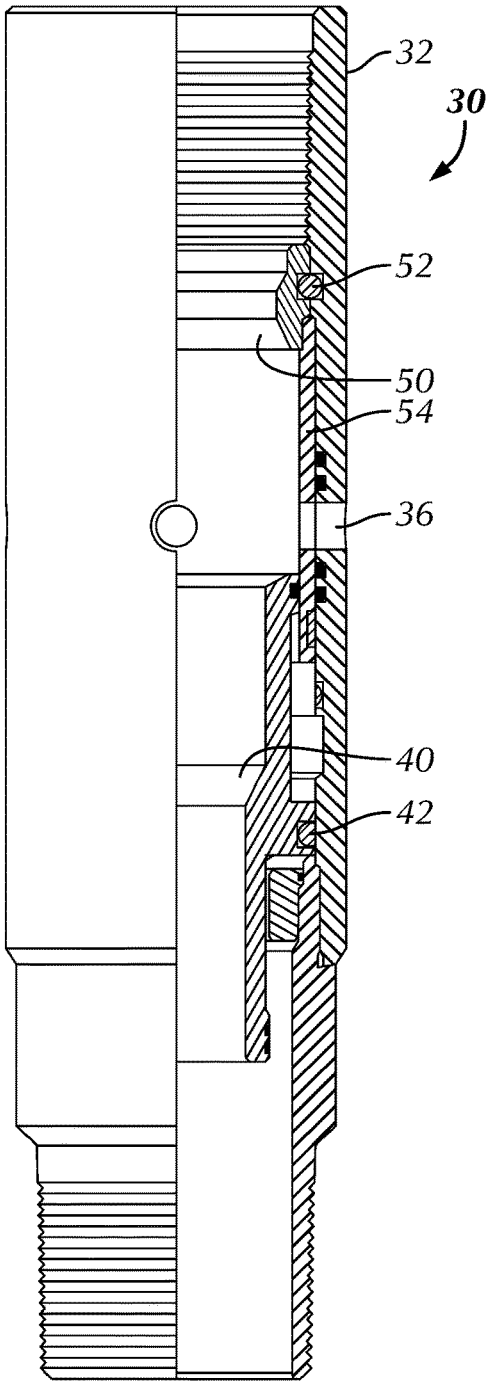
FIG. 4B (Prior Art)
Figure 4C:
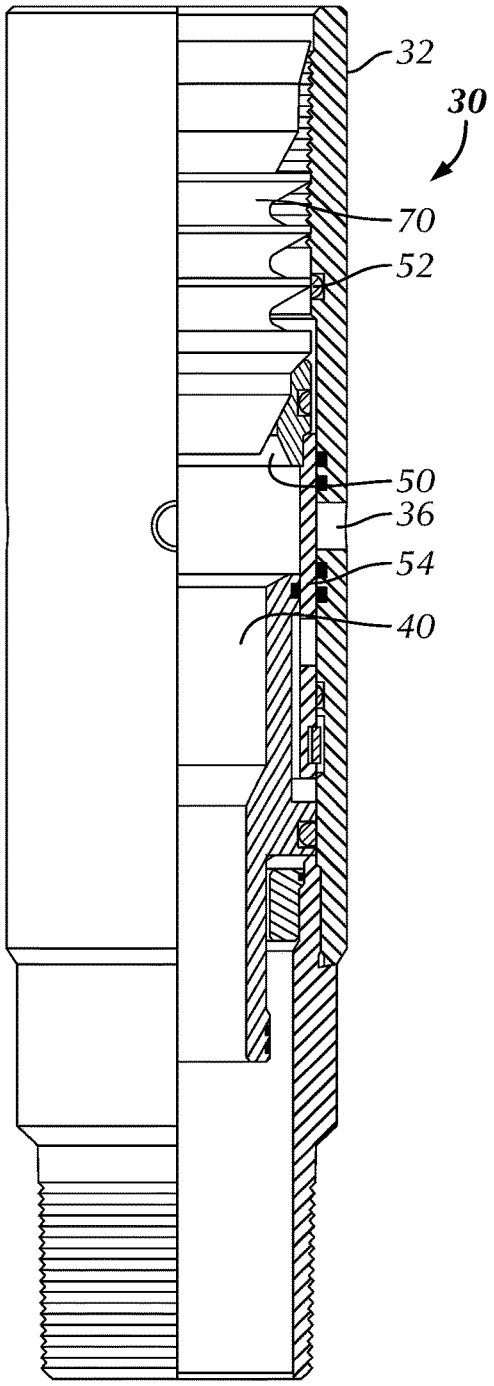
FIG. 4C (Prior Art)
Figure 5A:
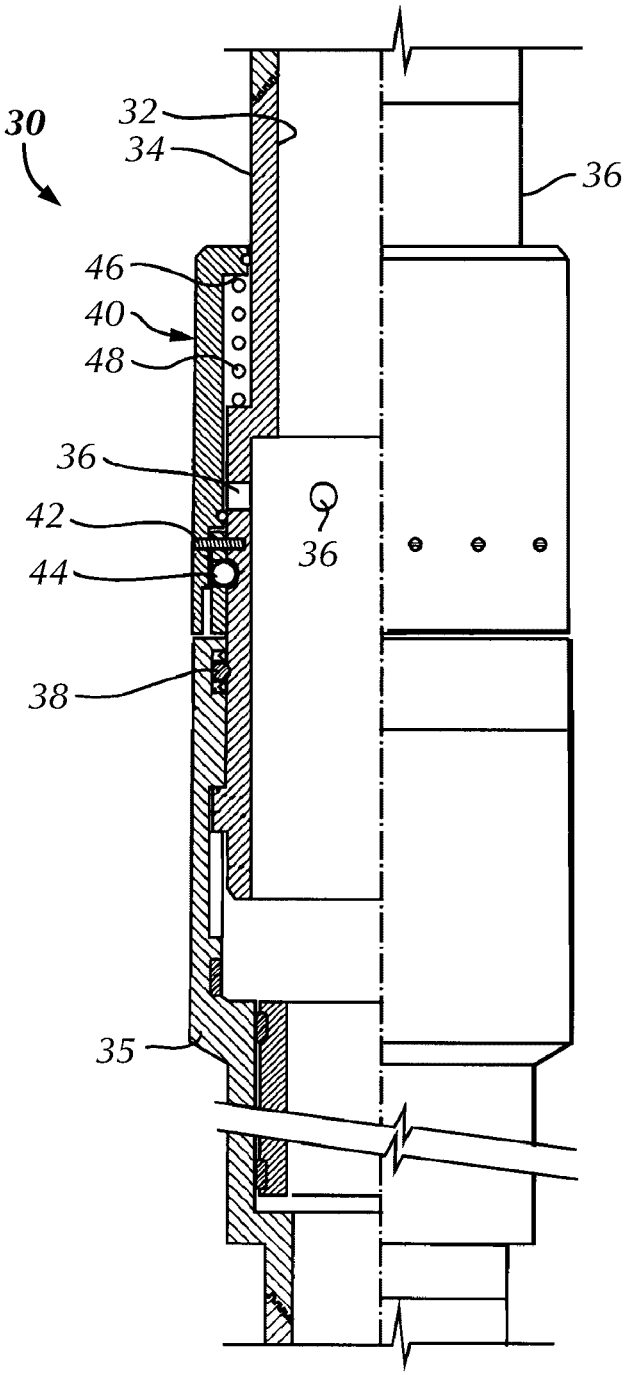
FIG. 5A (Prior Art)
FIGS. 5A-5C illustrate a tubing-manipulated stage tool according to the prior art in partial cross-section during operation.
Figure 5B:
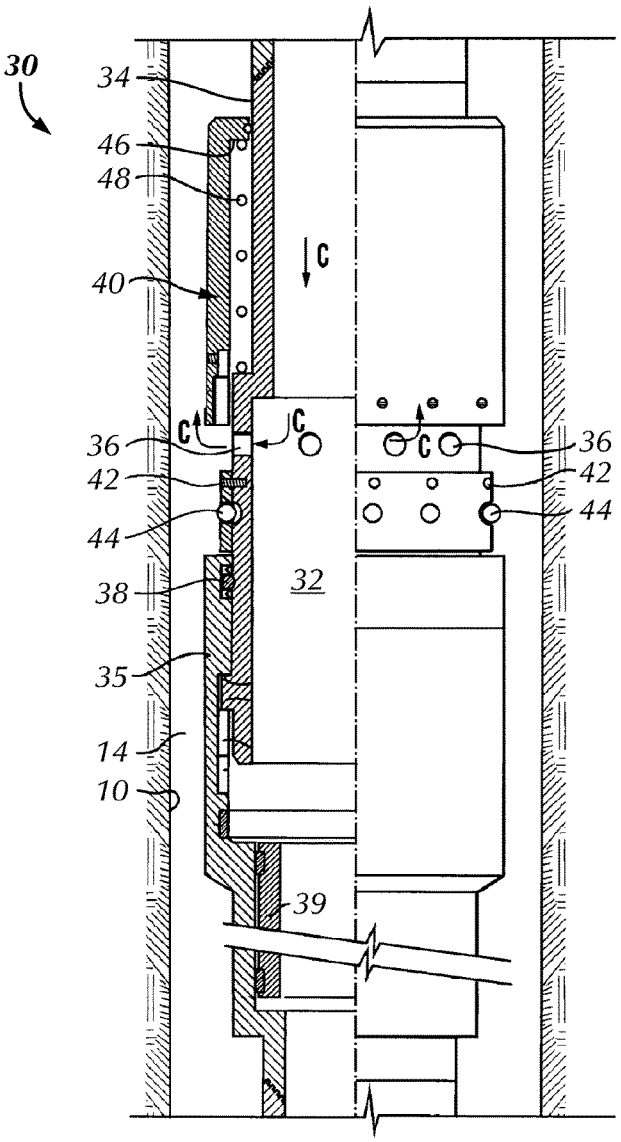
FIG. 5B (Prior Art)
Figure 5C:
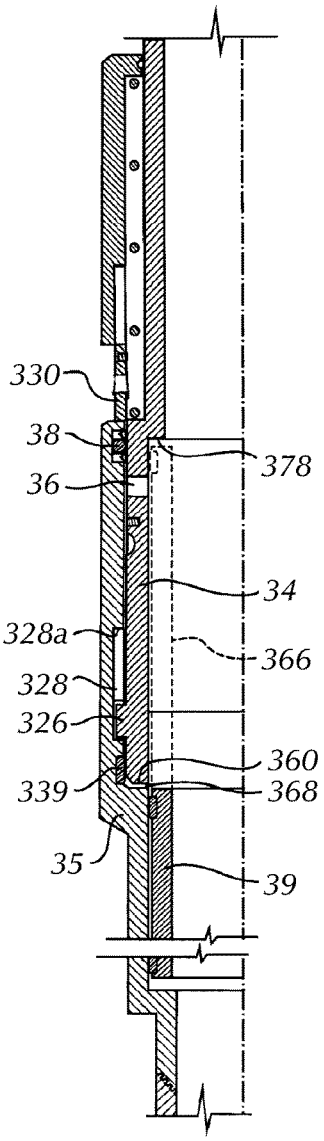
FIG. 5C (Prior Art)

Although not shown, a drillable seat similar to that disclosed above with reference to FIG. 2B can be used downhole of the tool 100 to catch a pumped down dart, dropped plug, tubing (conventional or coil) conveyed plug, and/or wire line (slick or electric) conveyed plug. Such a drillable seat can be added to the bottom sub 120*b* or other location. This can keep pressure applied to the casing in the tool 100, but can prevent pressuring up the casing below the tool 100 so the port 114 can be opened with pressure.

Finally, rotational catches 128, 138, and 148*a-b* in the form of castellations, teeth, or the like are used to limit rotation of the sleeves 130 and 140 when moved to a closed position. In particular, the downhole end of the closing sleeve 130 has rotational catches or castellations 138, the protective sleeve 140 has rotational catches or castellations 148*a-b* at both ends, and a downhole ledge or shoulder 125 of the tool's housing 101 has rotational catches or castellations 128 defined therein. These castellations 128/138/148*a-b* have corresponding arrangements so that they can fit together with one another when the sleeves 130 and 140 are disposed end-to-end and against the downhole ledge 125. As expected, when the castellations 128/138/148*a-b* fit together, the castellations 128 of the downhole ledge 125 prevent the sleeves 130 and 140 from rotating inside the housing's bore 102, which allows the seat 135 and other internal elements to be milled/drilled out.

Figure 6C:
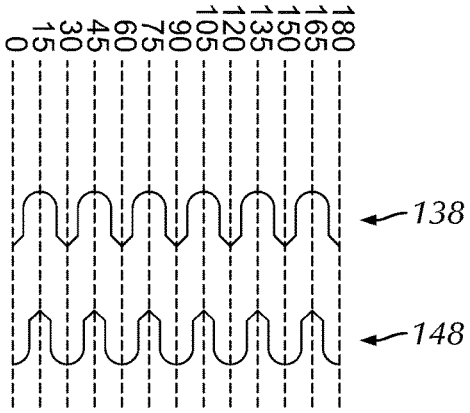
FIG. 6C schematically shows a projection of the castellations between sleeves from the first tool of FIG. 6A.

Particular details of one arrangement of castellations 138 and 148 are shown in FIG. 6C. The castellations 138 and 148 are shown projected over 180-degrees of the sleeves' diameters. Here, twelve castellations 138 are provided on the closing sleeve (130), and twelve castellations 148 are provided on the protective sleeve (140)—i.e., one tooth at every 30-degrees. More or less can be provided depending on the circumstances.

By having the castellations 128/138/148 as shown and described, the closing sleeve 130 can have increased wall thickness, making the sleeve 130 less susceptible to collapsing. The closing sleeve 130 can also be shorter, which makes movement of the sleeve 130 in the tool 100 less prone to freezing up from friction or the like. The non-rotating features of the castellations 138 located toward the end of the closing sleeve 130 do not need to be aligned with the other castellations 128/148 during assembly of the tool 100 because the castellations 128/138/148 will tend to align when they engage one another. To that point, the ends of the castellations 138 and 148 are angled to facilitate alignment.

Figure 7A:
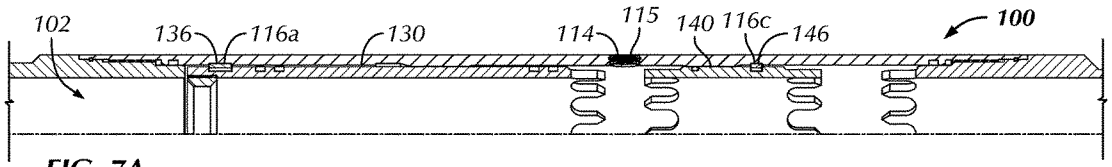
FIGS. 7A-7D illustrate the first tool of FIG. 6A in cross-sectional views during operational steps.

During operation, the stage tool 100 of FIG. 6A is deployed on a tubing string (e.g., casing, liner, or the like) in a run-in condition, as shown in FIG. 7A. The detent/lock ring 136 on the closing sleeve 130 can fit in an initial groove 116*a* and can act like a detent ring to hold the closing sleeve 130 in the run-in position. The detent ring 146 on the protecting sleeve 140 can also fit in an initial groove 116*c* to hold the sleeve 140 in place. The rupture disc 115 disposed in the exit port 114 is exposed in the housing's internal bore 102 between the ends of the two sleeves 130 and 140.

Figure 7B:
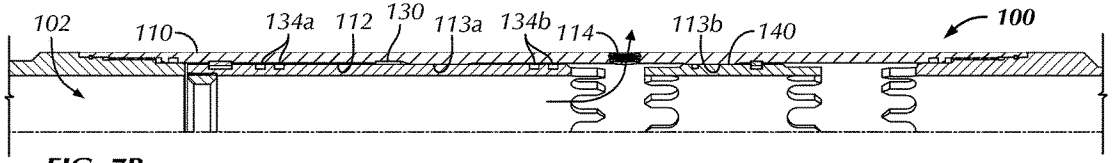

Various operation steps of a cementing operation can be conducted with the stage tool 100 in this configuration. For example, cementation of one stage can be conducted downhole of the tool 100. As then shown in FIG. 7B, a second operational step of the cementing operation commences when the rupture disc 115 is burst, ruptured, opened, or removed in the exit port 114 as pressure from cement slurry or other fluid is pumped down the tool's bore 102 and forces against the disc 115. As noted before, a first stage shut-off plug (e.g., 60: FIG. 2B) can be deployed downhole and through the tool 100 to land on a drillable seat (e.g., 65: FIG. 2B) and close off the casing downhole of the tool 100. Alternatively, some other type of plug can be deployed elsewhere downhole. Either way, applied pressure is allowed to increase in the tool's bore 102 and to eventually rupture the rupture disc 115. Once the exit port 114 opens, cement slurry and the like can communicate out of the port 114 and into the surrounding wellbore annulus.

Figure 7C:
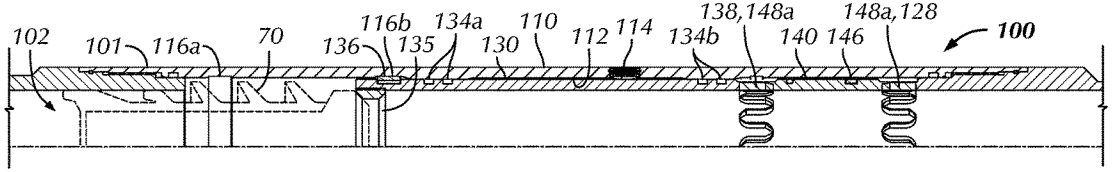

To reduce damage, the seals 134*a-b* on the closing sleeve 130 can be initially located in undercut areas or wells formed on the inside 112 of the case 110. In general, the seals 134*a-b* are not required to seal anything during run-in or during the first stage cement operation, if done, because the rupture disc 115 seals the inside bore 102 to the wellbore annulus during these operations. Instead, the seals 134*a-b* on the closing sleeve 130 are moved later to sealing areas 113*a-b* above and below the exit port 114 to seal off the port 114 when opened, as shown in FIG. 7C. Therefore, while the sleeve 130 is still in the open position as in FIG. 7B, the closing sleeve 130 protects the upper sealing area 113*a*. Meanwhile, the protective sleeve 140 remains disposed over the lower sealing area 113*b* downhole of the port 114. This keeps the sealing areas 113*a-b* from being exposed to flow during the first and second stage cementing steps.

Continuing now with operations as shown in FIG. 7C, a closing plug 70 eventually travels down the casing string toward a tail end of the cement slurry (not shown) and enters into the stage tool 100. The closing plug 70 engages the closing sleeve's seat 135, and pressure pumped behind the plug 70 forces the closing sleeve 130 to move toward its closed position in the housing's bore 102. The lock ring 136 releases from the upper groove 116*a* and eventually engages in the lower groove 116*b* to hold the closing sleeve 130 in place. As can be seen, the closing sleeve 130 can use the detent lock ring 136 instead of shear pins to hold the sleeve 130 in its initial position. The detent lock ring 136 also acts to lock the closing sleeve 130 in place once the sleeve 130 has been moved to the closed position. For instance, the lock ring 136 has a detent-angled shoulder on the leading edge and has a square-locking shoulder on the back edge.

The castellations 138 on the downhole end of the closing sleeve 130 fit with the corresponding castellations 148*a* on the protective sleeve 140, which is likewise moved downhole along with the closed sleeve 130. Eventually, the castellations 148*b* on the downhole end of the protective sleeve 140 mate with the corresponding castellations 128 on the bore's downhole ledge 125.

The external seals 134*a-b* of the closing sleeve 130 seal off the opened exit port 114, and the mating castellations 128/138/148*a-b* prevent rotating of the sleeves 130 and 140 in the housing's bore 102. As shown, two seal pairs 134*a* and 134*b* can be used per location on either side of the exit port 114 on the housing 101, and the seals 134*a-b* engage the raised sealed areas 113*a-b* on the inside 112 of the case 110.

Figure 7D:
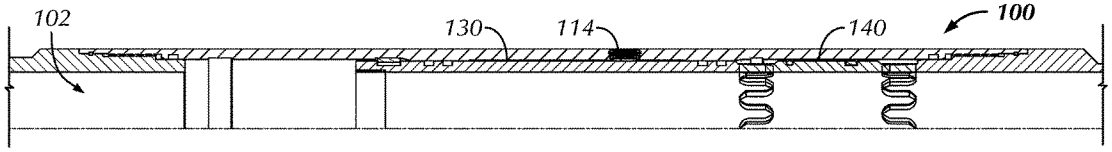

In a final operational step shown in FIG. 7D, a milling operation mills out the closing plug 70, seat 135, any residual cement (not shown), and the like from the tool's bore 102. When all is completed, the stage tool 100 can reduce the amount of drill-out required.

B. Second Embodiment of Hydraulically-Operated Stage Tool

Figure 8A:
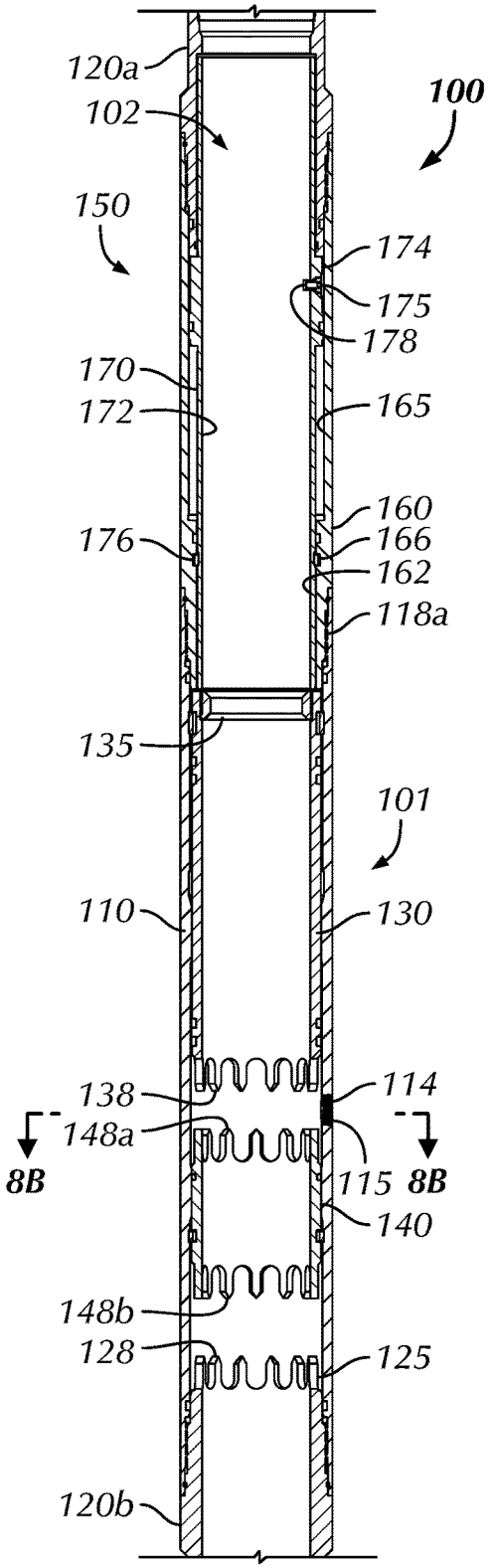
FIGS. 8A-8B illustrate a second embodiment of a hydraulically-operated stage tool according to the present disclosure in cross-sectional and end-sectional views.
Figure 8B:
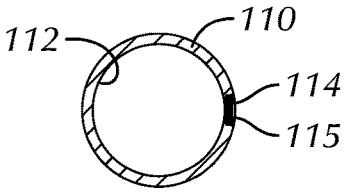
Figure 8C:
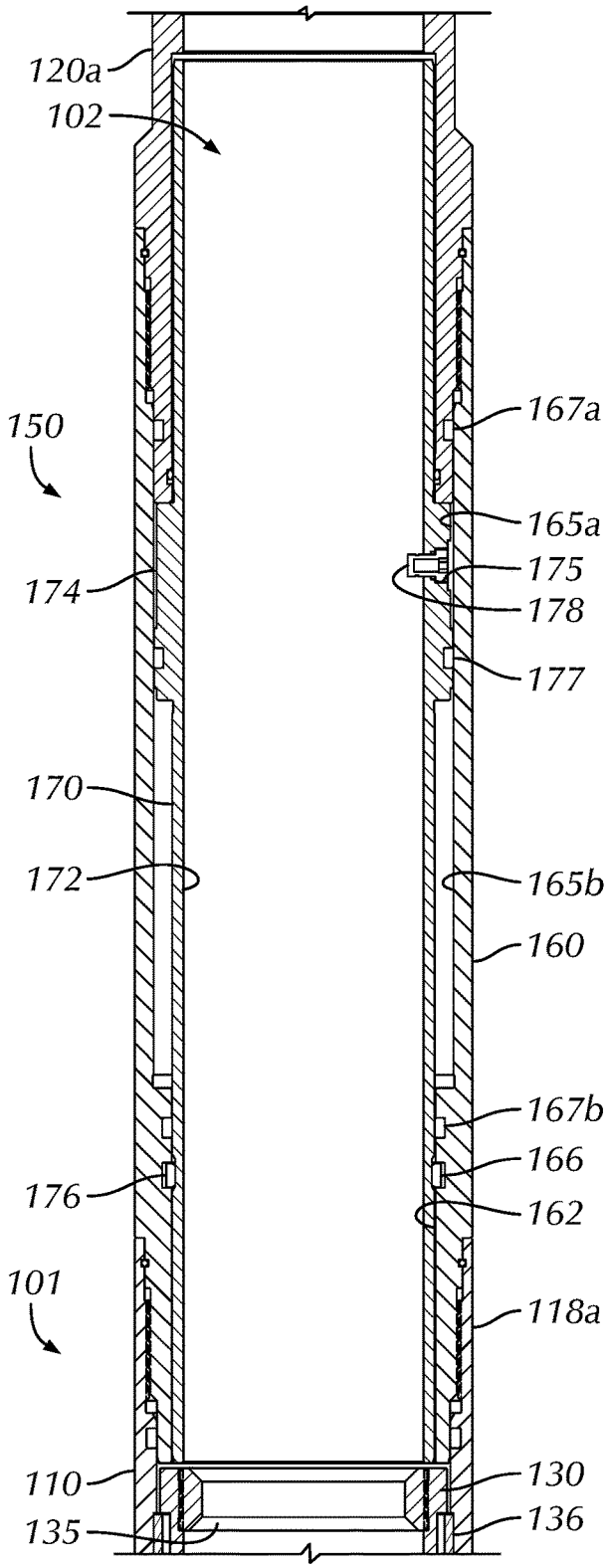
FIG. 8C illustrates the secondary closure mechanism of the second tool of FIG. 8A in isolated detail.

FIGS. 8A-8C illustrate a second embodiment of a hydraulically-actuated stage tool 100 according to the present disclosure in cross-sectional and end-sectional views. Many of the components of this second tool 100 are similar to those described above so like reference numerals are used for similar components. This second tool 100 includes a secondary closure mechanism 150 for closing the tool 100 during operations. As shown, the secondary closure mechanism 150 may be an additional component that couples to the end of the tool's housing 101 in place of the upper box sub 120*a*, which is instead connected to the end of the additional mechanism 150. As an alternative, the tool 100 can be integrally formed with the closure mechanism 150 integrated into the housing 101.

As best shown in the detail of FIG. 8C, the secondary closure mechanism 150 includes a chamber case 160 that threads to the end of the stage tool's case 110. A secondary closing mandrel 170 is movably disposed in the internal bore 162 of the chamber case 160 and can be held in place by a detent ring 176 in a lock groove 166. Seals 167*a-b* and 177 seal off chambers 165*a-b* between the closing mandrel 170 and the interior of the chamber case 160. The lower chamber 165*b* can hold a vacuum, low pressure, or some predefined pressure therein.

On the mandrel 170, a piston head 174 has a port 175 with a temporary plug 178, such as a knock off pin, disposed therein. The port 175 can communicate the interior 102 of the tool 100 with the upper chamber 165*a*, which is shown unexpanded in FIG. 8C.

The secondary closure mechanism 150 uses a pressure differential between the chambers 165*a-b* to move the secondary closing mandrel 170, causing it to push the tool's primary closing sleeve 130 to the closed position. As shown in FIG. 8C, one way of moving the secondary closing mandrel 170 uses the knock off pin 178. The knock off pin 178 is activated by a closing plug (e.g., 70) or by passage of some other plug, dropped and/or pumped down ball, dropped tube, tool (including slick and/or electric wireline tools and workstring tools, e.g., drill bit), or element, which breaks the pin 178 so fluid in the internal bore 102 can pass through the port 175 into the upper chamber 165*a*. As fluid pressure inside the internal bore 102 enters the upper chamber 165*a* behind the piston 174, the mandrel 170 shifts and closes (or at least aids in the closing of) the primary closing sleeve 130.

The secondary closure mechanism 150 may or may not be used to move the closing sleeve 130 depending on the cementing operations employed. Either way, the stage tool 100 may still have a seat 135 disposed on the closing sleeve 130. The seat 135 may be used as a backup feature for the mechanism 150, may be used in conjunction with the mechanism 150, or may simply be available for an alternate form of actuation.

Figure 9A:
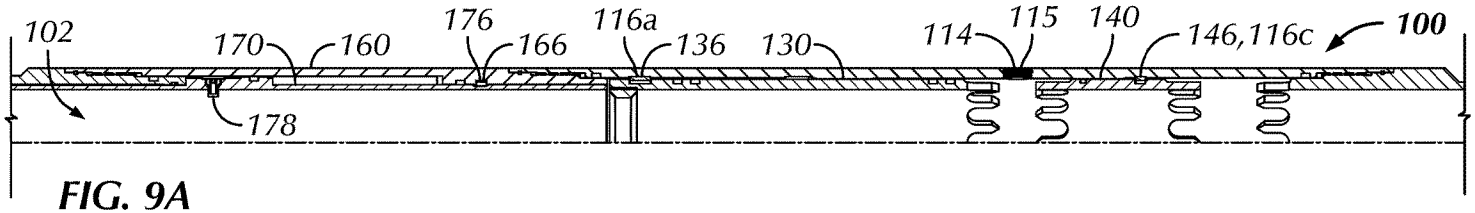
FIGS. 9A-9D illustrates the second tool of FIG. 8A in cross-sectional views during operational steps.

During operation, the stage tool 100 is deployed on the tubing string (e.g., casing, liner, or the like) in a run-in condition, as shown in FIG. 9A. The detent lock ring 138 on the closing sleeve 130 can fit in the initial groove 116*a* to hold the sleeve 130 in the run-in position. The closing mandrel 170 can also have its detent ring 176 fit in an initial groove 166, and the detent ring 146 on the protective sleeve 140 can also fit in an initial groove 116*c* to hold the sleeve 140 in place. The rupture disc 115 disposed in the exit port 114 is exposed in the bore 102 between the ends of the two sleeves 130 and 140.

Figure 9B:
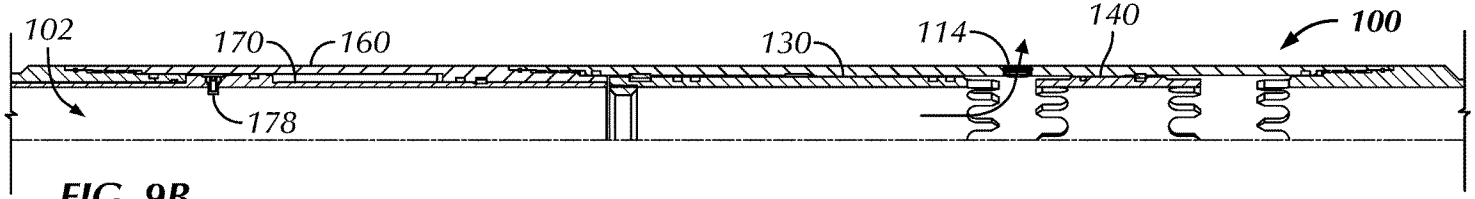

As noted above, a number of operational steps of a cementing operation can be performed with the tool 100 in its closed condition. As then shown in FIG. 9B, a second operational step of a cementing operation commences when the rupture disc 115 is burst, ruptured, opened, or removed in the exit port 114 as pressure from cement slurry (not shown) or other fluid is pumped down the tool's bore 102 and forces against the disc 115.

As noted before, an opening plug (e.g., 60: FIG. 2B) can be deployed downhole and through the tool 100 to land on a drillable seat (e.g., 65: FIG. 2B) and close off the casing downhole of the tool 100. Alternatively, some other type of plug can be deployed elsewhere downhole. Passage of such an opening plug is not intended to break the temporary plug 178 of the closing mechanism 150. Either way, applied pressure is allowed to increase in the tool's bore 102 and to eventually rupture the rupture disc 115. Once the exit port 114 opens, cement slurry and the like can communicate out of the port 114 and into the wellbore annulus.

Figure 9C:
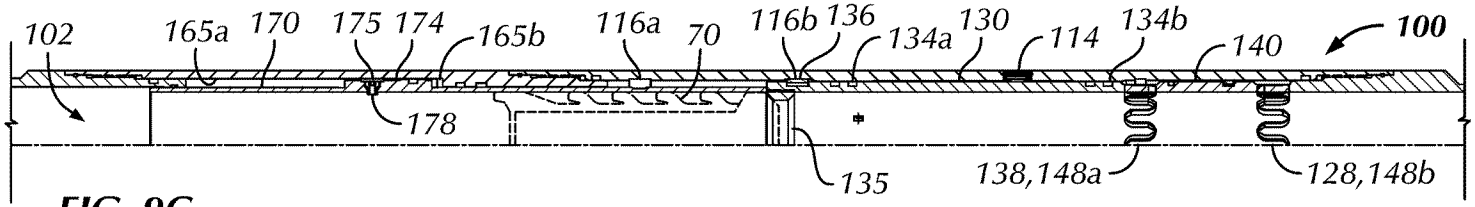

Toward a tail end of the cement slurry, a closing plug 70 travels down the casing string and enters into the stage tool 100, as shown in FIG. 9C. The closing plug 70 breaks the knock-off pin 178 in the port 175 of the mandrel's piston 174. Fluid pressure behind the plug 70 can then enter the expanding upper chamber 165*a* behind the mandrel's piston 174. The buildup of pressure in the expanding chamber 165*a* pushes against the mandrel's piston 174, which then moves to decrease the volume of the vacuum chamber 165*b*. Movement of the closing mandrel 170 in turn transfers to the closing sleeve 130, which moves to close off the exit port 114. As also shown, the closing plug 70 may engage the closing sleeve's seat 135 (if present), and pressure from the pumped fluid behind the plug 70 can also force the closing sleeve 130 to move toward its closed position in the housing's bore 102.

Figure 9D:
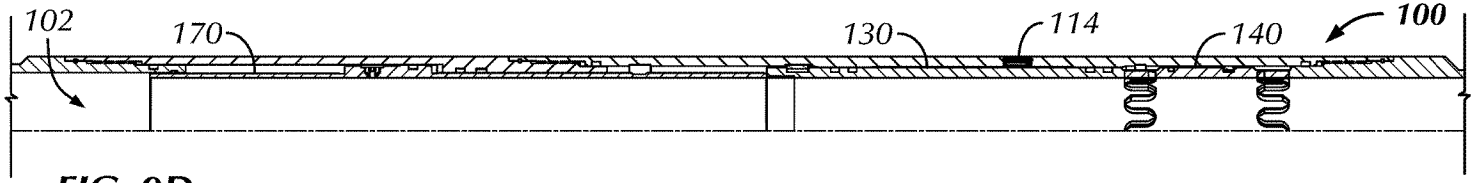

Either way, the detent lock ring 136 releases from the upper groove 116*a* and eventually engages in the lower groove 116*b* to hold the closing sleeve 130 in place. The castellations 128/138/148*a-b* mate with one another, and the external seals 134*a-b* of the closing sleeve 130 close off the opened exit port 114 and prevent rotating of the sleeves 130 and 140. In a final operational step shown in FIG. 9D, a milling operation mills out the closing plug 70, seat 135, any residual cement, and the like from the tool's bore 102.

C. Third Embodiment of Hydraulically-Operated Stage Tool

Figure 10A:
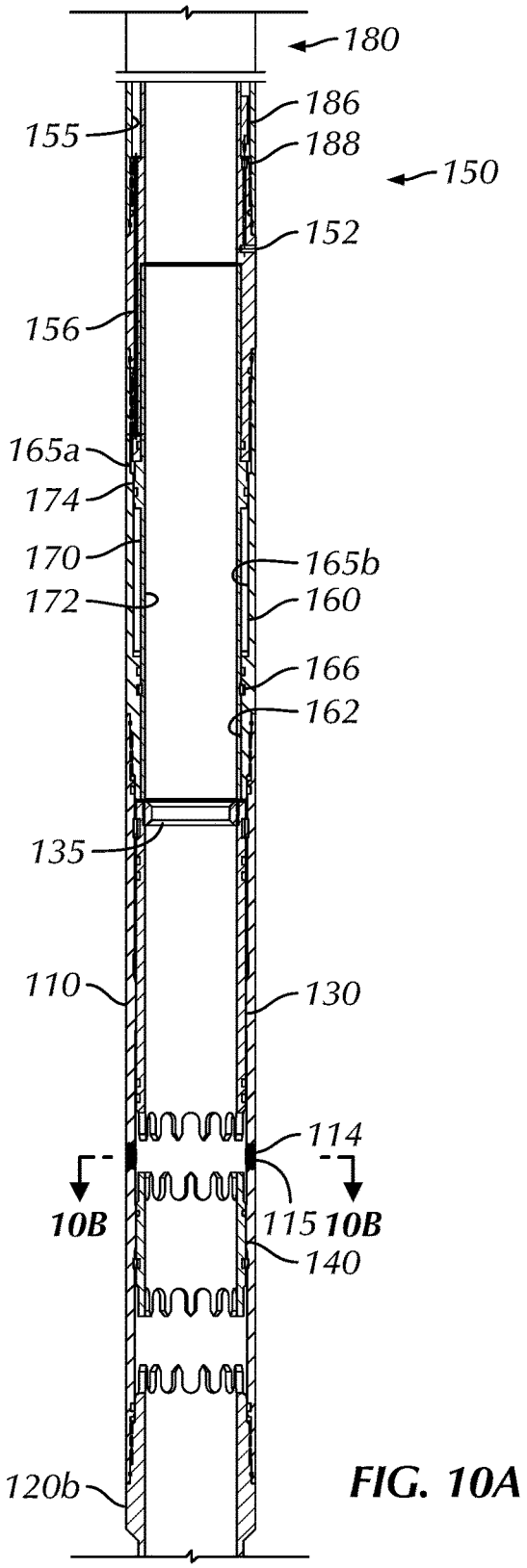
FIGS. 10A-10B illustrate a third embodiment of a hydraulically-operated stage tool according to the present disclosure in cross-sectional and end-sectional views.
Figure 10B:
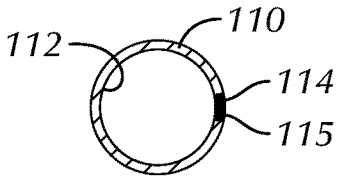
Figure 10C:
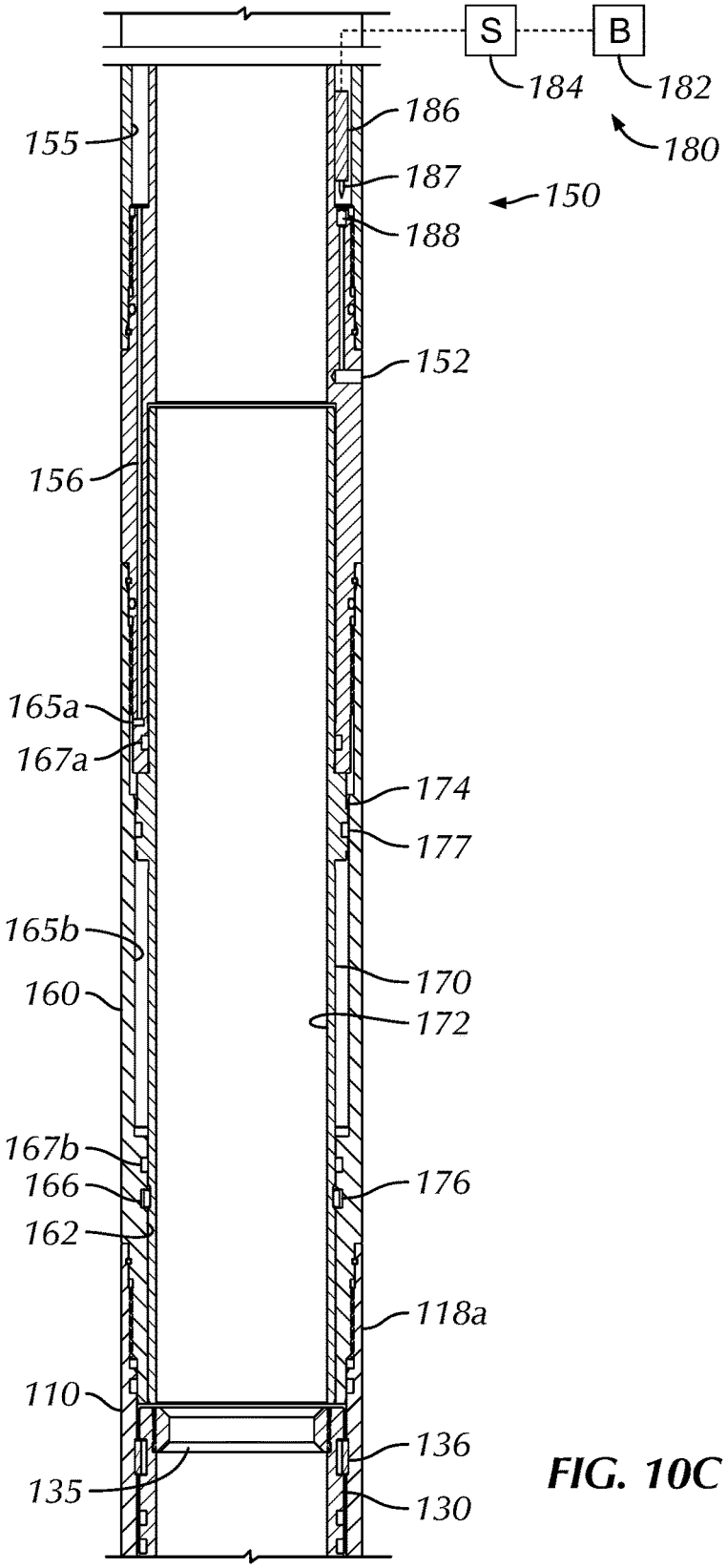
FIG. 10C illustrates the secondary closure mechanism of the third tool in FIG. 10A in isolated detail.

FIGS. 10A-10C illustrate a third embodiment of a hydraulically-operated stage tool 100 according to the present disclosure in cross-sectional and end-sectional views. Many of the components of this third tool 100 are similar to those described above so like reference numerals are used for similar components. This third tool 100 also includes a secondary closure mechanism 150 for closing the tool 100 during operations. As shown, the closure mechanism 150 may be an additional component that couples to the end of the housing 101 in place of the upper box sub 120*a*, which is instead connected to the end of the additional mechanism 150.

Although the secondary closure mechanism 150 is shown as an additional component having a case 160, a mandrel 170, and the like, it will be appreciated that the components of the closure mechanism 150 can be incorporated directly into the other components of the tool 100. For example, as with the tool 100 of FIGS. 8A-8C as well, the closing mandrel 170 may be integrally part of the closing sleeve 130, and/or the vacuum chamber case 160 can be integrally connected to the housing's case 110. Having the components separate provides more versatility to the stage tool 100 and can facilitate assembly and use. Either way, the stage tool 100 may still have a seat 135 disposed on the closing sleeve 130. The seat 135 may be used as a backup feature for the closure mechanism 150, may be used in conjunction with the closure mechanism 150, or may simply be available for an alternate form of actuation.

As best shown in the detail of FIG. 10C, the closure mechanism 150 includes a vacuum chamber case 160 that threads to the end 118*a* of the stage tool's case 110. A secondary closing mandrel 170 is movably disposed in the vacuum chamber case 160 and can be held in place by a detent ring 176 in a lock groove 166. Seals 167*a-b* and 177 seal off chambers 165*a-b* between the mandrel 170 and the interior of the case 160. The lower chamber 165*b* can hold a vacuum, low pressure, or some predefined pressure therein.

An electronic valve system 180 disposed on the closure mechanism 150 as part of the tool 100 has electronic components, such as a battery 182, a sensor 184, and solenoid 186. Some details are only schematically illustrated. The solenoid 186 has a pin 187 movable by activation of the solenoid 186. The sensor 184 can be a radio-frequency identification reader, a Hall Effect sensor, a pressure sensor, a mechanical switch, a timed switch, or other sensing or activation component. Depending on its characteristics, the battery 182 may be operable for approximately one month after the tool 100 is placed downhole.

Electronic activation by the electronic valve system 180 shifts the secondary closing mandrel 170. The electronic valve system 180 can be activated with any number of techniques. For example, RFID tags in the flow stream, which may be attached/contained in or to the closing plug, can be used to provide instructions; chemicals and/or radioactive tracers can be used in the flow stream; pressure pulses can be communicated downhole if the system is closed chamber (e.g., cement bridges off in the annular area between the casing outside diameter and borehole before the closing plug reaches the tool); or pulses can be communicated downhole if the system is actively flowing. These and other forms of activation can be used.

When a particular activation occurs, the sensor 184 causes the solenoid 186 to activate so the solenoid's pin 187 breaks a rupture disc 188 or other seal. At this point, the closure mechanism 150 uses activation fluid drawn externally from the wellbore annulus via an external port 152 to move the closing mandrel 170. However, the closure mechanism 150 can work equally well using activation fluid drawn internally from the tool's internal bore 102 with a comparable inner port (not shown).

Mechanisms other than the solenoid 186, the pin 187, and the like as disclosed above can be used in the electronic valve system 180. As one example, the electronic valve system 180 in FIG. 10D-1 has a pin 187 biased by a spring 189 to engage a rupture disc 188 of the port 152. However, a retaining cord 185 composed of synthetic fiber or other material holds the biased pin 187 back. When a particular activation occurs via the sensor 184, power supplied from the battery 182 to a heating coil or fuse 183 can heat the cord 185 to ash (or otherwise break the cord 185). At this point, the biased pin 187 is released and breaks the disc 188 so fluid can flood the chamber 155 and pass to the piston chamber (165*a*; FIG. 10C) via port 156.

Figures 2, 10D:
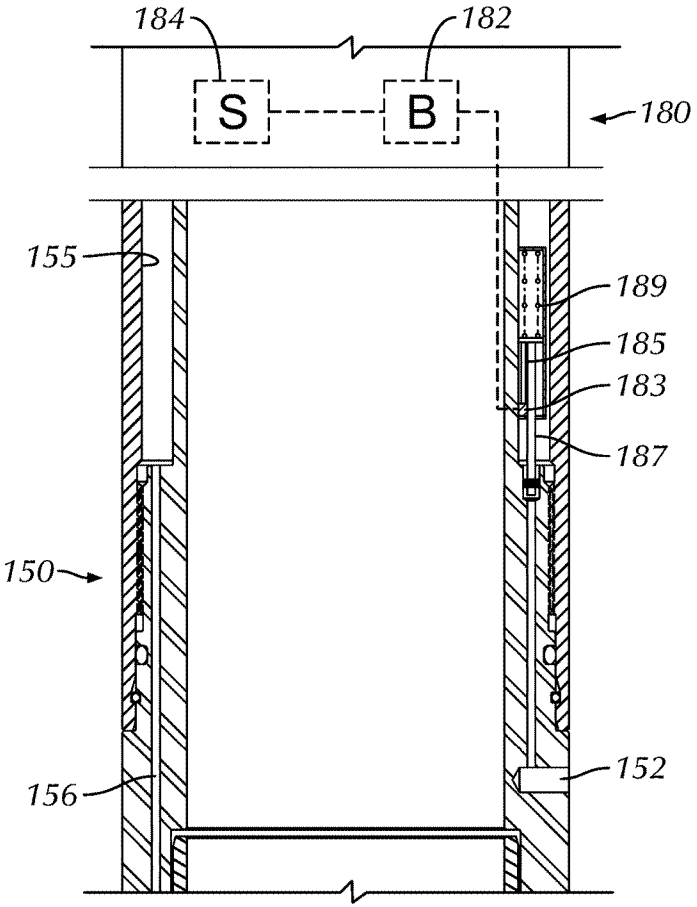
Figures 1, 10D:
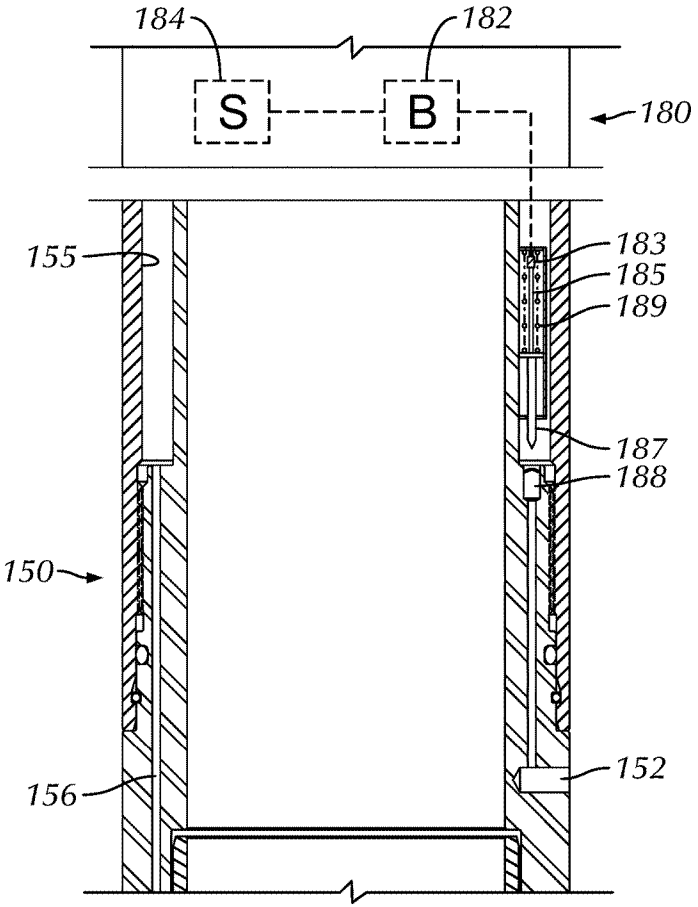

In another example, the electronic valve system 180 in FIG. 10D-2 uses the pin 187 as a biased piston that plugs fluid communication through the port 152. The pin 187 has seals disposed on its distal end for sealing the port 152. Here, a spring 189 is expanded to pull the pin 187 from the port 152, but a retaining cord 185 composed of synthetic fiber or other material can hold the biased pin 187 in place. When a particular activation occurs via the sensor 184, power supplied from the battery 182 to a heating coil or fuse 183 can heat the cord 185 to ash (or otherwise break the cord 185). At this point, the biased pin 187 releases its plugging of the port 152, and fluid can flood the chamber 155 and pass to the piston chamber (165*a*; FIG. 10C) via port 156. As will be appreciated, these and other mechanism can be used in the electronic valve system 180 to control fluid communication through the port 152.

Figures 11A, 11B, 11C, 11D:
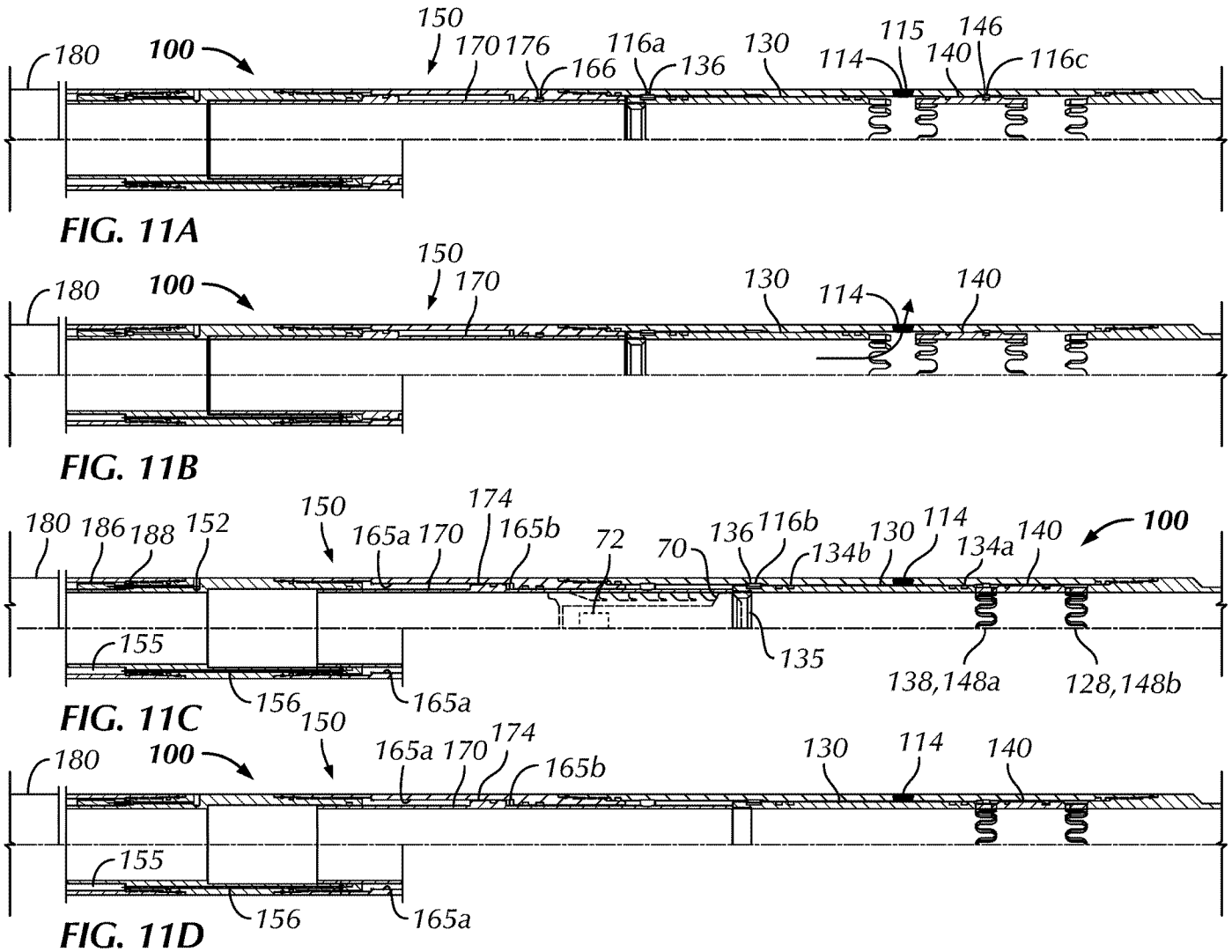
FIGS. 11A-11D illustrates the third tool of FIG. 10A in cross-sectional views during operational steps.

During operation, the stage tool 100 is deployed on the casing string in a run-in condition, as shown in FIG. 11A. The detent lock ring 136 on the closing sleeve 130 can fit in an initial groove 116*a* to hold the sleeve 130 in the run-in position. The closing mandrel 170 can also have its detent ring 176 fit in an initial groove 166, and the detent ring 146 on the protecting sleeve 140 can also fit in an initial groove 116*c* to hold the sleeve 140 in place. The rupture disc 115 disposed in the exit port 114 is exposed in the bore 102 between the ends of the two sleeves 130 and 140.

As shown in FIG. 11B, a first operational step of a cementing operation commences when the rupture disc 115 is burst, ruptured, opened, or removed in the exit port 114 as pressure from cement slurry or other fluid is pumped down the tool's bore 102 and forces against the disc 115. As noted before, an opening plug (e.g., 60: FIG. 2B) can be deployed downhole and through the tool 100 to land on a drillable seat (e.g., 65: FIG. 2B) and close off the casing downhole of the tool 100. Alternatively, some other type of plug can be deployed elsewhere downhole. Passage of such an opening plug is not intended to activate the closing mechanism 150, although it could initiate a timed response by the mechanism 150. Either way, applied pressure is allowed to increase in the tool's bore 102 and to eventually rupture the rupture disc 115. Once the exit port 114 opens, cement slurry and the like can communicate out of the port 114 and into the wellbore's annulus.

Toward a tail end of the cement slurry, a closing plug 70 travels down the casing string and enters into the stage tool 100, as shown in FIG. 11C. The closing plug 70 can include an RFID tag, magnetic component, or other type of sensing element 72 detectable by the sensor 184 in the electronic valve system 180 of the tool 100. As noted above, any other forms of activation can be used. For example, an RFID tag in the flow stream can be used by itself without a closing plug 70, a pressure pulse can be used, or any of the other forms of activation.

Once activation is detected, the solenoid 186 activates and ruptures the disc 188. Fluid pressure from the wellbore annulus can enter the external port 152 of the closure mechanism 150, enter a back chamber 155 of the component 150, and pass through an axial port 156 from the back chamber 155 to the expanding chamber 165*a* behind the mandrel's piston 174. The buildup of pressure in the expanding chamber 165*a* pushes against the mandrel's piston 172, which then moves to decrease the volume of the vacuum chamber 165*b*.

The resulting movement of the closing mandrel 170 in turn transfers to the closing sleeve 130, which moves to close off the exit port 114. As also shown, the closing plug 70 can engage the closing sleeve's seat 135 (if present), and pressure from the pumped slurry can also force the closing sleeve 130 to move toward its closed position in the housing's bore 102.

Either way, the detent lock ring 136 releases from the upper groove 116*a* and eventually engages in the lower groove 116*b* to hold the closing sleeve 130 in place. The castellations 138 on the downhole end of the closing sleeve 130 fit with the corresponding castellations 148*a* on the protective sleeve 140, which is likewise moved downhole along with the closed sleeve 130. Eventually, the castellations 148*b* on the downhole end of the protective sleeve 140 mate with the corresponding castellations 128 on the bore's downhole ledge 125. The external seals 134*a-b* of the closing sleeve 130 seal off the opened exit port 114, and the mating castellations 128/138/148*a-b* prevent rotating of the sleeves 130 and 140. In a final operational step shown in FIG. 11D, a milling operations mills out the closing plug 70, seat 130, any residual cement, and the like from the tool's bore 102.

As with previous embodiments, the secondary closure mechanism 150 and the elimination of a drillable closing sleeve reduces the overall milling required. Opening flow with the rupture disc 115 can accomplish the opening of the stage tool 100, and the secondary method of shifting the closing sleeve 130 to the closed position can assist in closing the tool 100 with or without a closing plug 170.

D. Fourth Embodiment of Hydraulically-Operated Stage Tool

Figure 12A:
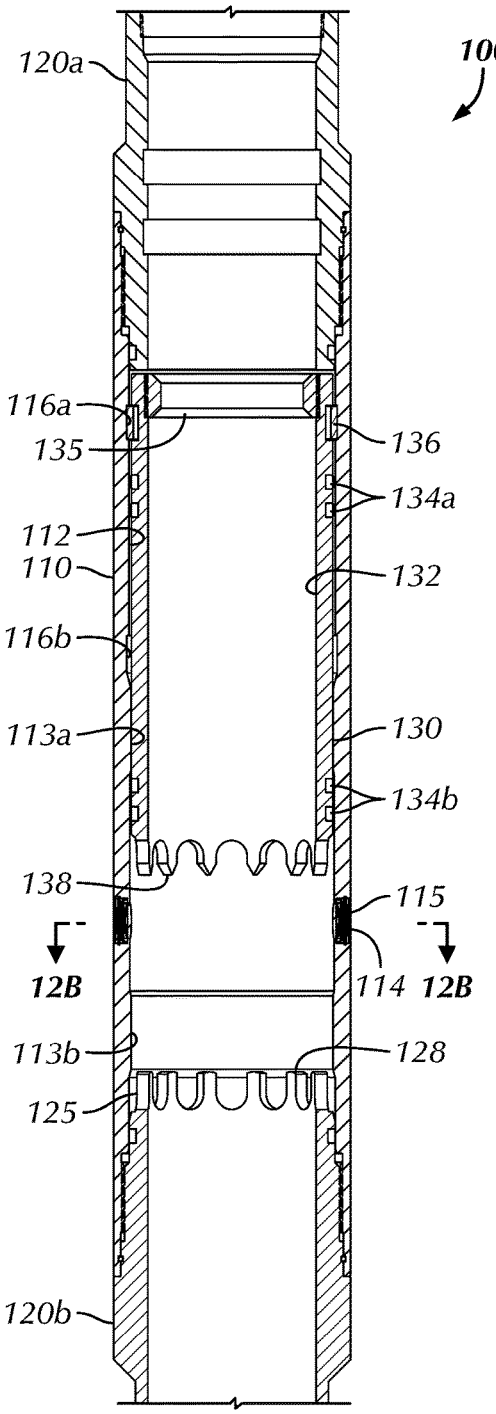
FIGS. 12A-12B illustrate a fourth embodiment of a hydraulically-operated stage tool according to the present disclosure in cross-sectional and end-sectional views.
Figure 12B:
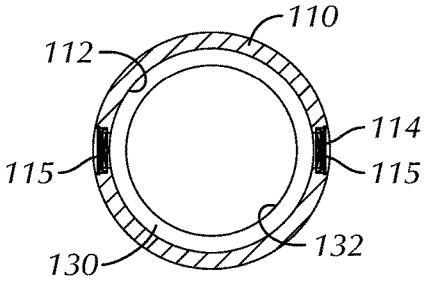

FIGS. 12A-12B illustrate a fourth embodiment of a hydraulically-operated stage tool 100 according to the present disclosure in cross-sectional and end-sectional views. Many of the components of this third tool 100 are similar to those described above so like reference numerals are used for similar components.

Figure 12C:
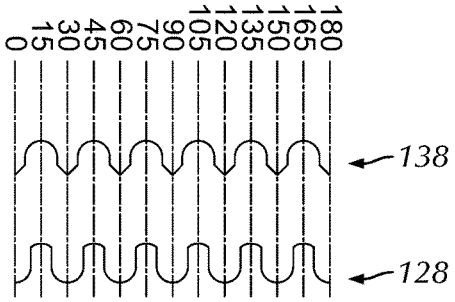
FIG. 12C schematically shows a projection of the castellations between sleeves from the fourth tool of FIG. 12A.

As can be seen, the tool 100 lacks a protective sleeve (e.g., 140 in previous Figures) and instead includes just the closing sleeve 130. During operation, the closing sleeve 130 moves in the housing's bore 102 from the open condition (FIG. 12A) to a closed condition (not shown) covering the tool's port 114. Operation of the tool 100 is similar to the operation of the other disclosed tools 100 with the exception that the sleeve 130 has castellations 138 that engage directly with the ledge's castellations 128 on the lower sub 120*b*. FIG. 12C schematically shows a projection of the castellations 128/138 for half the diameter of the tool 100.

The tool 100 is shorter than previous embodiments and can benefit from many of the same advantages discussed previously. The lower sealing area 113*b* inside the housing's bore 102 remains exposed during part of the tool's use. The surface of this area 113*b* may include an appropriate surface treatment, erosion resistant coating, polishing process (e.g., quench polish quench (QPQ) hardening), spray on weldment, or the like for protection, if needed. This tool 100 can be combined with or can incorporate any of the secondary closure mechanisms 150 disclosed herein.

Figure 13A:
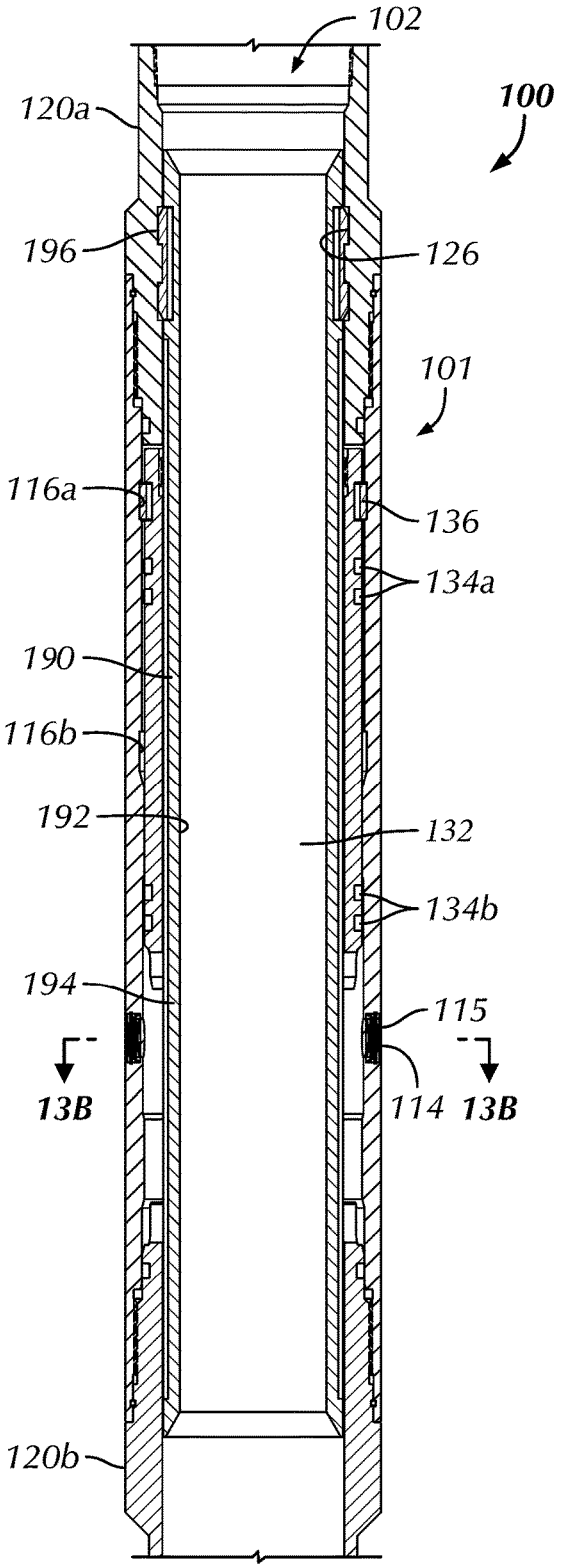
FIGS. 13A-13B illustrates a variation of the fourth stage tool of FIG. 12A having an insert 190 disposed therein.
Figure 13B:
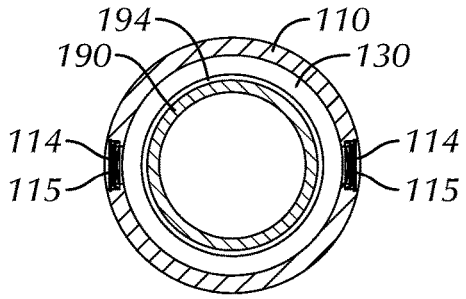

FIGS. 13A-13B illustrate a variation for the stage tool 100 of FIG. 12A. This third tool 100 has the same components as those described above so that like reference numerals are used for similar components. As shown, an insert 190 disposes inside the bore 102 of the housing 101 to close off flow through the exit port 114 once the rupture disc 115 is ruptured. The insert 190 is cylindrical and has a through-bore 192 and an external seal 194. The insert 190 also includes keys 196 that engage in lock profiles 126 defined inside the upper sub 120*a* of the tool 100.

The insert 190 can be used if the closing sleeve 130 fails to close or for some other reason. For example, the insert 190 installs by wireline or other method inside the housing's bore 102 once flow out of the exit port 114 is to be stopped during cementing operations, but the sleeve 130 is not or does not close. With the insert 190 in place, the external seal 194 prevents communication through the exit port 114. In fact, the length of the insert 190 and its external seal 194 can cover all of the existing seals and joints on the tool 100. The external seal 194 can be composed of an elastomer and may even be composed of a swellable material to further facilitate sealing.

E. Fifth Embodiment of Hydraulically-Operated Stage Tool

Figure 14A:
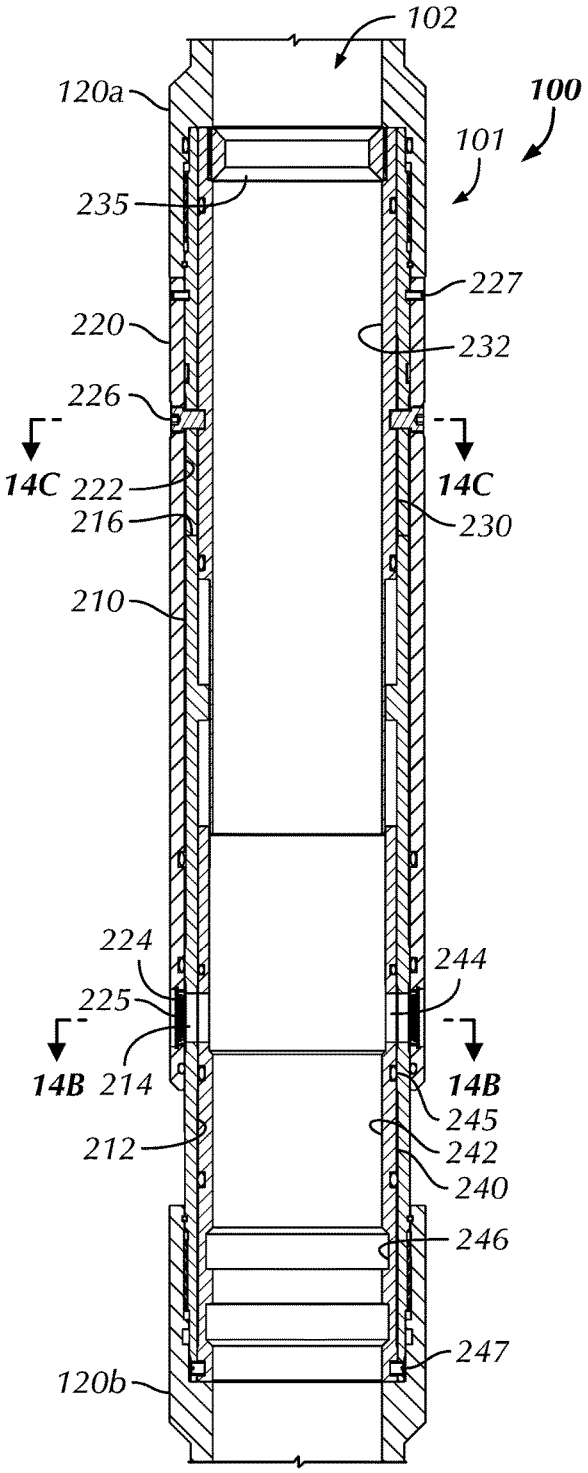
FIGS. 14A-14C illustrate a fifth embodiment of a hydraulically-operated stage tool according to the present disclosure in cross-sectional and end-sectional views.
Figure 14B:
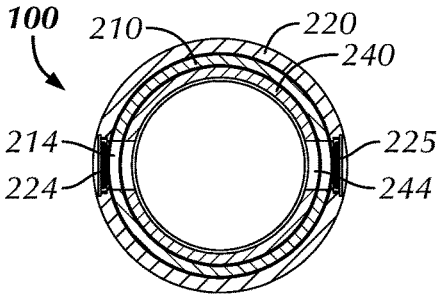
Figure 14C:
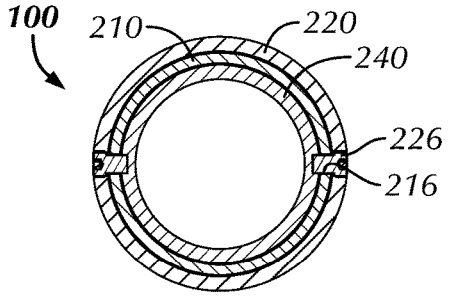

FIGS. 14A-14B illustrate a fifth embodiment of a hydraulically-operated stage tool 100 according to the present disclosure in cross-sectional and end-sectional views. Many of the components of this fifth tool 100 are similar to those described above so like reference numerals are used for similar components.

The tool 100 includes a closing sleeve or insert 230, an external sealing sleeve 220, and an internal sealing sleeve 240 that are moveable on the tool's case 210. The external sleeve 220 is disposed on the outside of the tool's case 210 so that the external sleeve 220 can slide along its bore 222 on the outside of the case 210.

The closing sleeve 230 is disposed inside the tool's case 210 and is coupled by connection screws 226 to the external sleeve 220. These screws 226 can travel in slots 216 formed in the tool's case 210. The closing sleeve 230 also includes a seat 235 for engaging a closing plug (not shown) during cementing operations as described below. Finally, the internal sleeve 240 is also disposed inside the tool's case 210 and has a lock profile 246 disposed on the sleeve's bore 242.

In the run-in position shown in FIG. 14A, the internal and external sleeves 220 and 240 align ports 224 and 244 with exit ports 214 on the tool's case 210. Although any set of these ports can have a breachable obstruction or rupture disc, the exit ports 224 on the external sleeve 220 have rupture discs 225, which open fluid flow from the ports 214/224/244 out of the tool 100 and into the wellbore annulus during cementing operations.

Closing of the tool 100 during operations involves engaging a closing plug (not shown) on the seat 235 of the closing sleeve 230. Pressure applied behind the closing plug breaks shear pins 227 connecting the closing sleeve 230 and external sleeve 220 to the tool's case 210. The joined sleeves 220/230 move together with the applied pressure inside the tool 100, and the ports 224 on the external sleeve 220 move out of alignment with the case's exit ports 214 so fluid is prevented from flowing into and out of the tool 100. Seals inside the external sleeve 220 can seal the case's ports 214. At the same time, the end of the closing sleeve 230 may or may not cover the case's ports 214 on the inside of the tool's bore 102. Yet, the end of the sleeve 230 completes the internal diameter of the tool 100.

This tool 100 can be combined with or can incorporate any of the secondary closure mechanisms 150 disclosed herein. Additional or alternative closure of the tool 100 is provided by the internal sleeve 240. Keys of a wireline or other pulling tool can engage in the lock profiles 246 of the internal sleeve 240. An upward pull on the internal sleeve 240 shears the pins 247 and allows the internal sleeve 240 to move inside the tool's case 210. The sleeve's ports 244 move out of alignment with the tool's exit ports 214, and seals 245 on the internal sleeve 240 seal above and below the exit ports 214. A lock ring (not shown) on the internal sleeve 240 can lock in an internal groove of the case's bore 212 to hold the internal sleeve 240 closed.

Figure 14D:
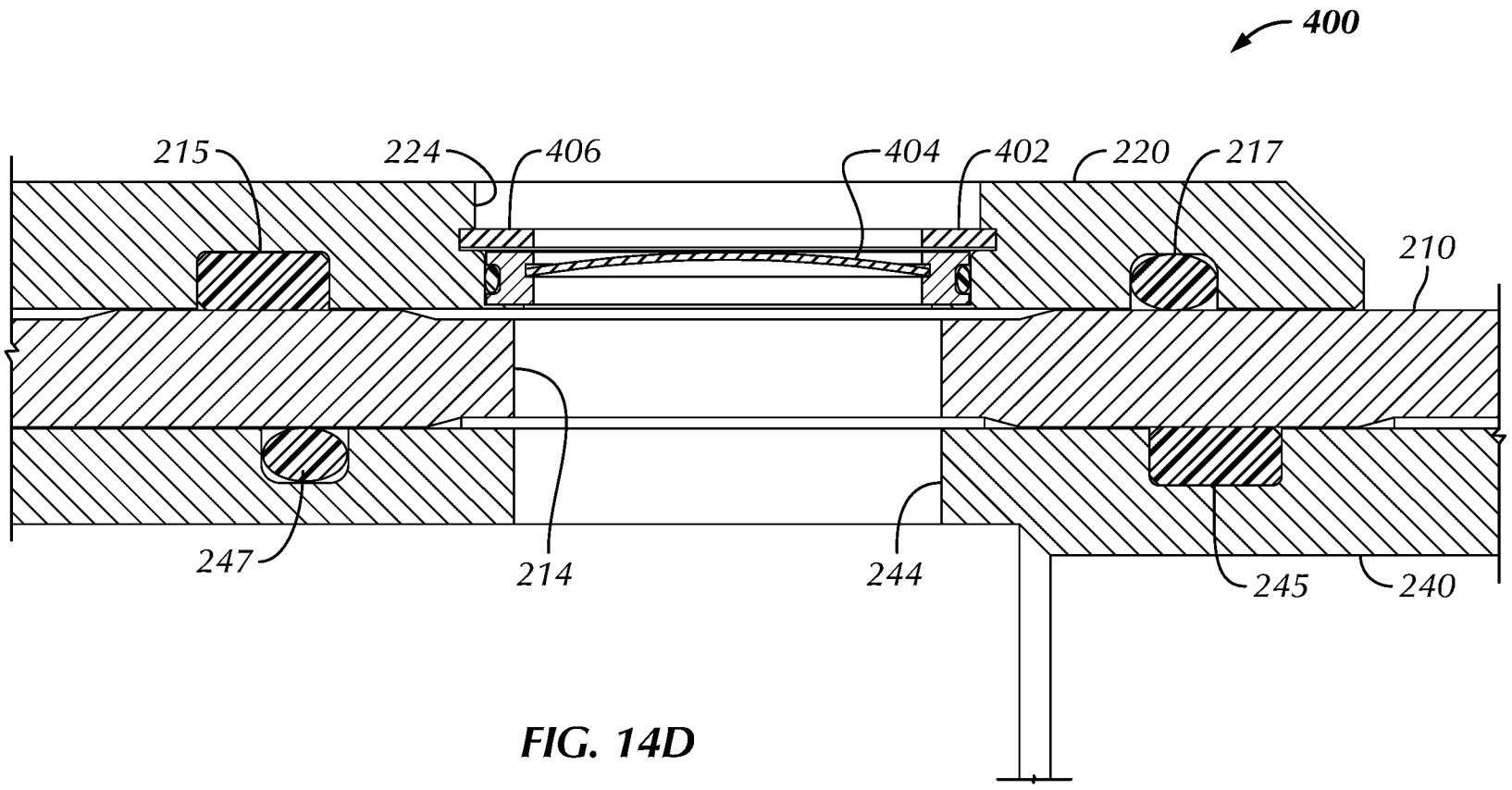
FIGS. 14D-14E illustrate embodiments of rupture discs according to the present disclosure.
Figure 14E:
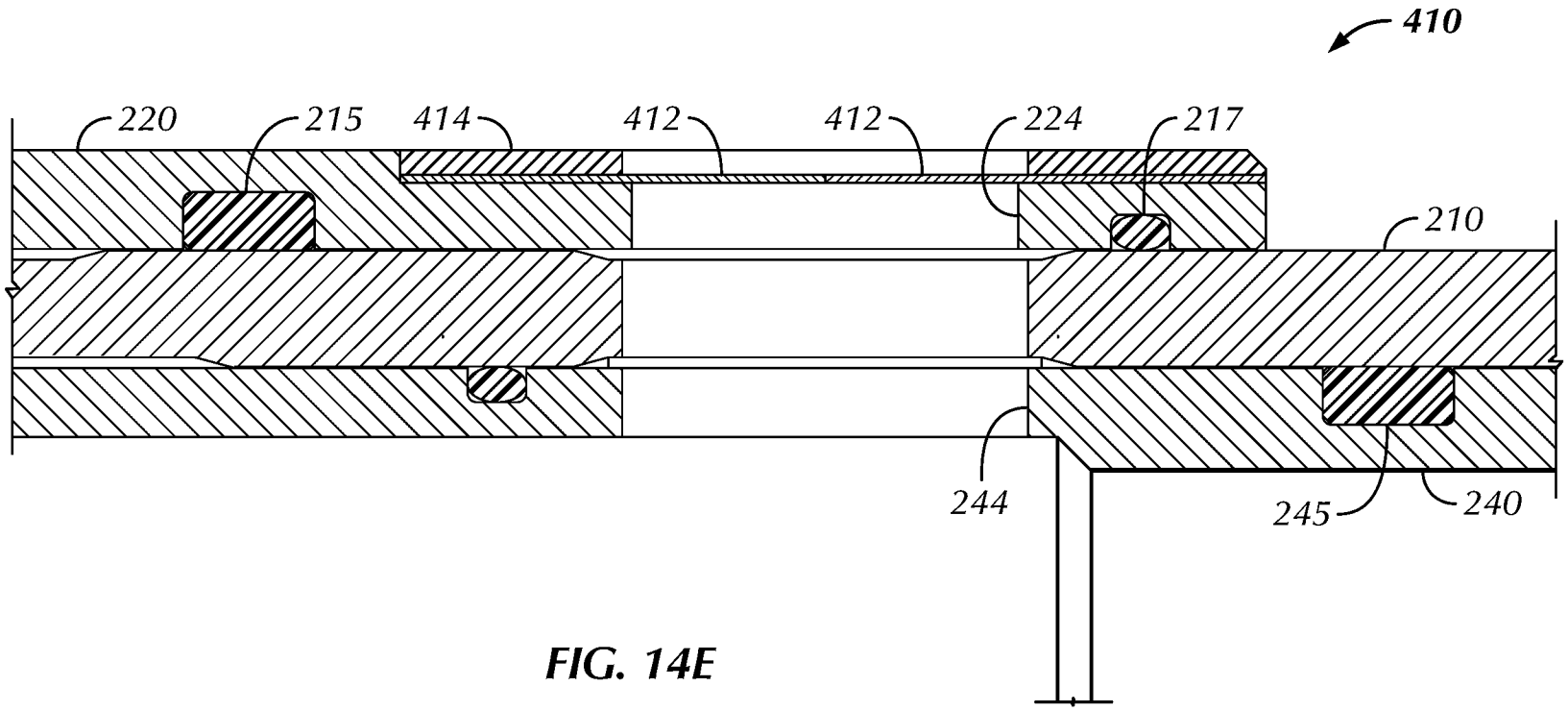

FIGS. 14D-14E illustrate embodiments of breachable obstructions or rupture discs according to the present disclosure. In FIG. 14D, a breachable assembly 400 is shown for use with the tool 100 of FIG. 14A and for other tools disclosed herein. The breachable assembly 400 includes a ring insert 402 having a rupture disc membrane 404 affixed therein. The insert 402 and membrane 404 fit into the port 224 on the external sleeve 220, and the insert 402 may include an external seal to engage in the port 224. A snap ring 406 or other fixture can then dispose in the port 224 to hold the insert 402 and membrane 404 therein.

Space limitations may not allow a conventional rupture disc to be used. As an alternative, FIG. 14E shows a breachable assembly 410 for use with the tool 100 of FIG. 14A and for other tools disclosed herein. This breachable assembly 410 has a thinner dimension than a conventional assembly. The assembly 410 has a plurality of (e.g., three) separate metal pieces 412 that are fit together by shrink fitting to cover the external sleeve's port 224. A fixture 414 such as a plate, washer, or the like affixes to the external sleeve 220 to hold the pieces 412 in place. Various means for fixing can be used, including shrink fitting, tack welding, brazing, etc. The assembly 410 constructed in this manner provides a rupture disc that can hold as much external differential pressure as internal differential pressure.

As an aside, FIGS. 14D-14E shows how the external sleeve 220 can have primary and secondary seals 215 and 217. The secondary seal 217 is disposed on the sleeve's distal end for sealing engagement with the case 210 when the external sleeve 220 is in the aligned condition of having its port 224 aligned with the case's port 214. The primary seal 215 seals off the case's port 214 when the external sleeve 220 is moved to a closed condition covering the case's port 214. The internal sleeve 240 has a comparable arrangement of primary and secondary seals 245 and 247.

F. Sixth Embodiment of Hydraulically-Operated Stage Tool

Figure 15A:
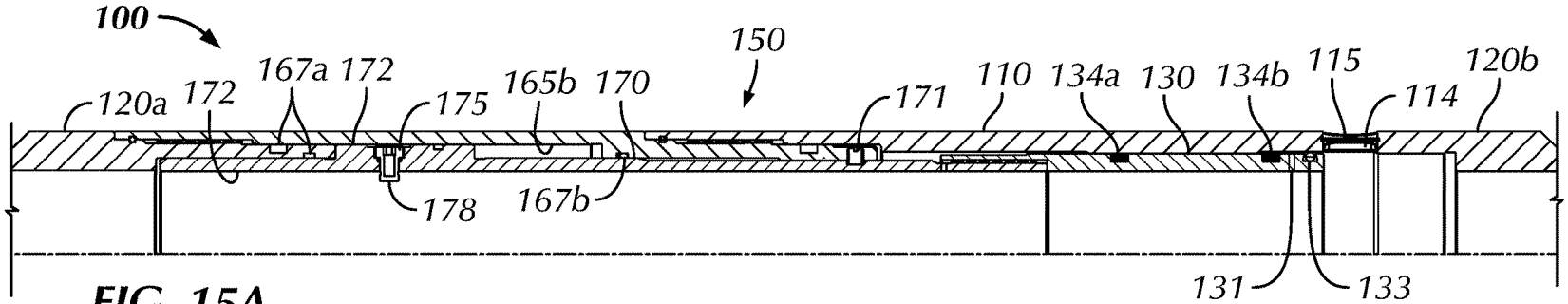
FIGS. 15A-15C illustrate a sixth embodiment of a hydraulically-operated stage tool according to the present disclosure in cross-sectional and end-sectional views.
Figure 15B:
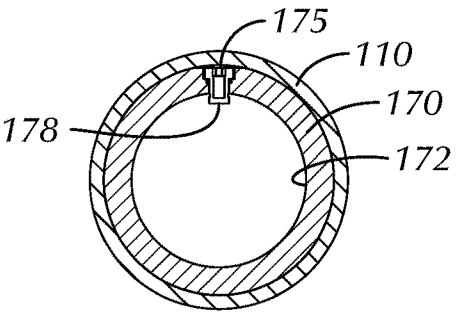
Figure 15C:
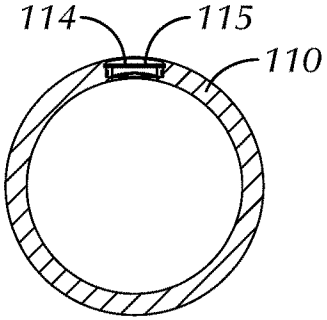

FIGS. 15A-15C illustrate a sixth embodiment of a hydraulically-operated stage tool 100 according to the present disclosure in a cross-sectional view and two end-sectional views. Many of the components of this sixth tool 100 are similar to those described above so like reference numerals are used for similar components. This tool 100 uses a secondary closure mechanism 150 integrally connected to the tool's case 110. The mechanism's mandrel 170 is coupled with the tool's closing sleeve 130.

Operation of the tool 100 is similar to that described above with reference to FIGS. 8A through 9D. Therefore, opening the exit port 114 involves bursting the rupture disc 115 so cementing can be performed. Operations can continue as before, except that a seat for a closing plug may not be used, although it could be if a seat is present. Instead, passage of a plug (not shown) breaks the knock off pin 178 disposed in the port 175 at the piston head 144 on the mandrel 170. Hydraulic pressure moves the mandrel 170 once the shear pins 171 break, and the mandrel 170 moves the connected closing sleeve 130 along with it to close off the exit port 114.

Although the closure mechanism 150 similar to that disclosed in FIGS. 8A-9D is shown, any of the other closure mechanism 150 disclosed herein can be comparably used on the tool 100 of FIGS. 15A-15C. Finally, seals 134*a-b* on the closing sleeve 130 seal off fluid flow through the exit port 114 once the sleeve 130 is closed. To protect the seals 134*a-b* during operations, a wiper seal 133 can be provided on the end of the sleeve 130 and can include an intermediate bypass 131 to prevent pressure lock.

G. Seventh Embodiment of Hydraulically-Operated Stage Tool

Figure 16:
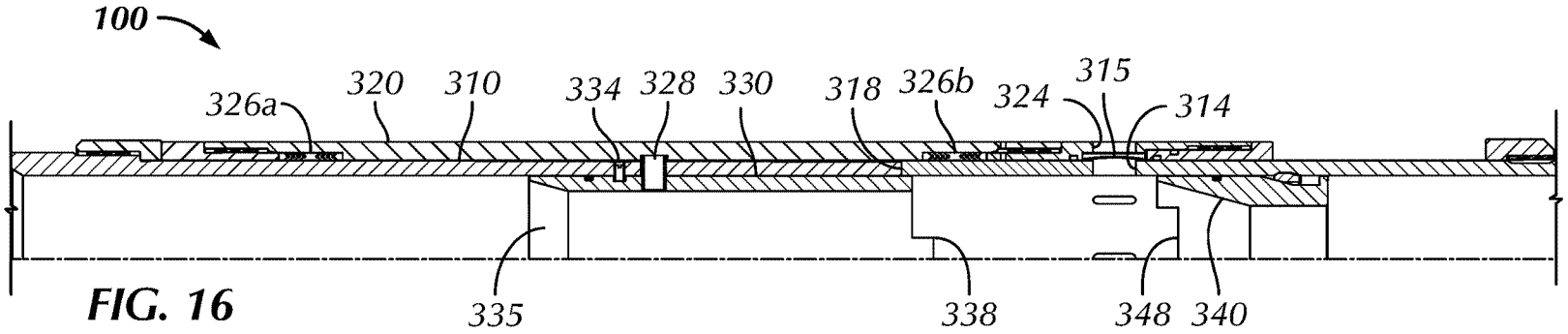
FIG. 16 illustrates a seventh embodiment of a hydraulically-operated stage tool according to the present disclosure in a cross-sectional view.

FIG. 16 illustrate a seventh embodiment of a hydraulically-operated stage tool 100 according to the present disclosure in a cross-sectional view. Many of the components of this seventh tool 100 are similar to those described above. The tool 100 includes a case 310, an external sleeve 320, an internal sleeve or insert 330, and a seat 340. The internal sleeve 330 couples to the external sleeve 320 using pins 328 that pass through slots 318 in the case 310. The two sleeves 320/330 therefore move together and are initially held in the run-in position shown by shear pins 334.

The case 310 has one or more exit ports 314 that align with one or more ports 324 on the external sleeve 320. One or more breachable obstructions 315, such as rupture discs, are disposed in the external sleeve's ports 324 to prevent fluid communication from the tool 100 to the surrounding borehole.

When a plug, ball, or the like is dropped to the seat 340, applied pressure from cement slurry or the like ruptures or breaks the rupture disc 315 so cement slurry can pass to the wellbore annulus. A closing plug (not shown) traveling at the tail end of the slurry eventually engages a seat 335 on the closing sleeve 330, and pressure applied behind the seated plug causes the shear pins 334 to break. The closing sleeve 330 and the external sleeve 320 then move together in the tool 100 until the rotational catches 338 on the closing sleeve 330 engage the catches 348 on the seat 340.

As the sleeves 320 and 330 move, the ports 324 move out of alignment with the exit port 314, and chevron seals 326*a-b* on the external sleeve 320 close off the exit port 314. Finally, the closing sleeve 330, the seat 340, and any plugs can be milled out after operations are complete.

H. Eighth Embodiment of Hydraulically-Operated Stage Tool

Figure 17:
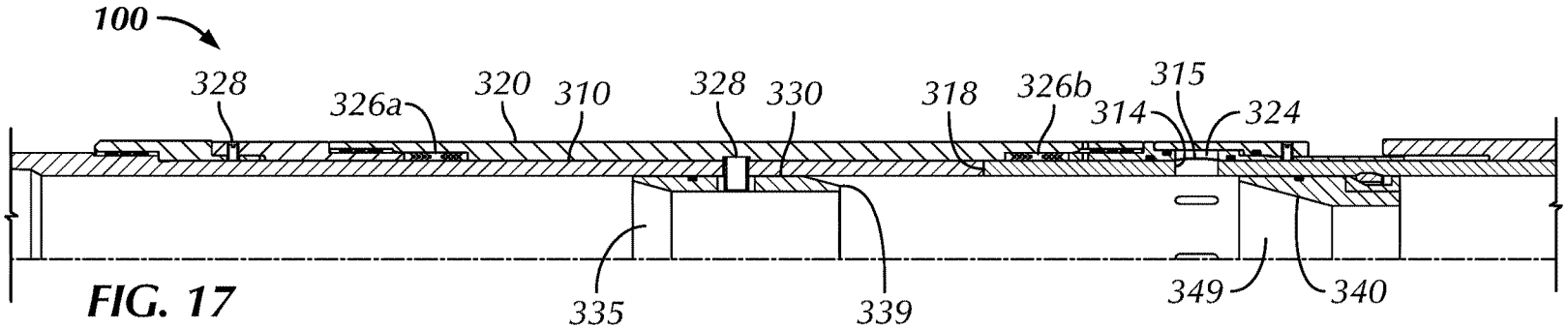
FIG. 17 illustrates an eighth embodiment of a hydraulically-operated stage tool according to the present disclosure in a cross-sectional view.

FIG. 17 illustrate an eighth embodiment of a hydraulically-operated stage tool 100 according to the present disclosure in a cross-sectional view. Many of the components of this eighth tool 100 are similar to those described above.

The tool 100 includes a case 310, an external sleeve 320, an internal sleeve or insert 330, and a seat 340. The internal sleeve 330 couples to the external sleeve 320 using pins 328 that pass through slots 318 in the case 310. The two sleeves 320/330 therefore move together and are initially held in the run-in position shown by shear pins 328.

The case 310 has one or more exit ports 314 that align with one or more ports 324 on the external sleeve 320. One or more breachable obstructions 315, such as rupture discs, are disposed in the external sleeve's ports 324 to prevent fluid communication from the tool 100 to the surrounding borehole.

When a plug (not shown) is dropped to the seat 340, applied pressure from cement slurry or the like ruptures or breaks the rupture disc 315 so cement slurry can pass to the wellbore annulus. A closing plug (not shown) traveling at the tail end of the slurry eventually engages a seat 335 on the closing sleeve 330, and pressure applied behind the seated plug causes the shear pins 328 to break. The closing sleeve 330 and the external sleeve 320 then move in the tool 100.

Eventually, the rotational catch in the form of a wedge 339 on the closing sleeve 330 engages the rotational catch in the form of a wedge 349 on the seat 340. The ports 324 move out of alignment with the exit ports 314, and the chevron seals 326*a-b* close off the ports 314. The closing sleeve 330, the seat 340, and any plugs can then be milled out after operations are complete.

I. Conclusion

As will be appreciated, the stage tools 100 disclosed herein may be used on a casing string having other components activated by fluid pressure. Therefore, the pressure for activating the stage tool 100 can be selected with consideration as to the other components to be actuated and if those components need be actuated before or after the stage tool.

Although the secondary closure mechanisms 150 disclosed herein have been shown as an additional component having their own case, mandrel, and the like, it will be appreciated that the components of the mechanisms 150 can be incorporated directly into the other components of the various embodiments of the stage tools 100. For example, a closing mandrel of the mechanism 150 may be integrally part of a closing sleeve of the stage tool, and/or the vacuum chamber case of the mechanism 150 can be integrally connected to the housing's case. Having the components separate provides more versatility to the stage tool 100 and can facilitate assembly and use.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter. Thus, although secondary closure mechanisms 150 have been described in FIGS. 8A through 11D for use with features of the stage tool 100 depicted in FIG. 6A, it will be appreciated with the benefit of the present disclosure that any of the various stage tools 100 disclosed herein can include such closure mechanisms 150.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A stage tool for cementing casing in a wellbore annulus, the tool comprising:

a housing disposed on the casing and having a first internal bore and an exit port, the exit port communicating the first internal bore with the wellbore annulus;

a first breachable obstruction disposed on the tool and preventing fluid communication through the exit port, the first breachable obstruction breached in response to a first fluid pressure component in the first internal bore acting against the first breachable obstruction and permitting fluid communication through the exit port when breached;

an internal sleeve movably disposed in the first internal bore of the housing and having a second internal bore, the sleeve movably disposed at least from an initial position to a closed position relative to the exit port at least in part in response to a second fluid pressure component; and an insert sleeve separate from the tool and inserting at least partially in the first internal bore of the housing and in the second internal bore of the internal sleeve, the insert sleeve having at least one key engaging in a lock profile of the first internal bore, the insert sleeve installed in the tool preventing fluid communication through the exit port.

2. The tool of claim 1 wherein:

the first breachable obstruction is exposed to the first internal bore of the housing during run-in and initial operation and is unbreached to an initial fluid pressure component in the first internal bore acting against the breachable obstruction during the run-in and the initial operation of the stage tool; and wherein the internal sleeve is in the initial position leaving the first breachable obstruction exposed to the initial fluid pressure component during the run-in and the initial operation of the stage tool, the internal sleeve moving from the initial position to the closed position at least in part in response to the second fluid pressure component, the internal sleeve in the closed position covering the exit port and preventing fluid communication through the exit port.

3. The tool of claim 1, wherein the first breachable obstruction comprises a rupture disc disposed in the exit port of the housing and breached in response to the first fluid pressure component in the first internal bore.

4. The tool of claim 1, wherein the internal sleeve comprises seals disposed externally thereon and sealably engaging in the first internal bore of the housing, the seals sealing off the exit port when the internal sleeve is in the closed position.

5. The tool of claim 1, wherein the internal sleeve comprises a seat disposed in the second internal bore, the internal sleeve moving from the initial position to the closed position at least in part in response to the second fluid pressure component applied against a plug engaged in the seat.

6. The tool of claim 1, wherein the housing comprises at least one first rotational catch in the first internal bore; wherein the internal sleeve comprises at least one second rotational catch thereon; and wherein the first and second rotational catches restrict rotation of the internal sleeve in the closed position relative to the first internal bore.

7. The tool of claim 6, wherein the at least one first rotational catch comprises a plurality of first castellations disposed about an internal shoulder in the first internal bore of the housing; and wherein the at least one second rotational catch comprises a plurality of second castellations disposed on an end of the internal sleeve.

8. The tool of claim 1, further comprising an intermediate sleeve disposed in the first internal bore and being moveable in the first internal bore at least from a first position to a second position, the intermediate sleeve in the first position being disposed away from the internal sleeve and a shoulder in the first internal bore, the intermediate sleeve in the second position being engaged between the internal sleeve and the shoulder.

9. The tool of claim 8, wherein the intermediate sleeve comprises third rotational catches disposed on opposing ends thereof, the third rotational catches mating with first and second rotational catches on the internal sleeve and the shoulder respectively.

10. The tool of claim 8, wherein the intermediate sleeve in the first position at least partially covers a sealing area defined on the first internal bore of the housing against which a portion of the internal sleeve seals when disposed in the closed position.

11. The tool of claim 1, wherein the insert sleeve comprises an external seal disposed about an external surface of the insert sleeve and engaging at least partially in the first and second internal bores.

12. The tool of claim 11, wherein the external surface and the external seal cover existing seals and joints in the tool.

13. The tool of claim 11, wherein the external seal is composed of an elastomer or a swellable material.

14. The tool of claim 1, further comprising a closure mechanism moving the internal sleeve from the initial position to the closed position at least in part in response to the second fluid pressure component.

15. The tool of claim 14, wherein the closure mechanism comprises a piston disposed in a chamber of the housing, the piston movable in the chamber in response to a pressure differential from the second fluid pressure component applied across the piston between first and second portions of the chamber.

16. The tool of claim 15, wherein the closure mechanism comprises a separate case coupled to the housing and continuing the first internal bore therewith; and wherein the piston comprises a mandrel movable with the piston to move the sleeve.

17. The tool of claim 15, wherein the piston comprises a seal sealing a low pressure in the first portion of the chamber.

18. The tool of claim 15, wherein the piston comprises an inlet port communicating the second portion of the chamber with the first internal bore, the inlet port having a second breachable obstruction preventing fluid communication through the inlet port.

19. The tool of claim 18, wherein the second breachable obstruction a pin disposed in the inlet port and breaking away therefrom to open fluid communication through the inlet port.

20. The tool of claim 14, wherein the housing comprises an inlet port communicating the second portion of the chamber with the first internal bore or with the wellbore annulus, the inlet port having a valve operable to allow fluid communication through the inlet port to the second portion of the chamber.

21. The tool of claim 20, wherein the valve comprises a second breachable obstruction preventing fluid communication through the inlet port at least until breached.

22. The tool of claim 21, wherein the valve comprises a solenoid activatable to breach the second breachable obstruction and allow fluid communication through the inlet port.

23. The tool of claim 21, wherein the valve comprises:

a pin biased from a closed state to an opened state relative to the inlet port;

a cord retaining the pin in the closed state; and a fuse breaking the cord and releasing the pin to the opened state.

24. The tool of claim 14, wherein the closure mechanism comprises a sensor activating the closure mechanism to move the sleeve in response to a sensed condition.

25. The tool of claim 24, wherein the sensor comprises a reader responsive to passage of at least one radio frequency identification tag.

26. A method of cementing casing in a wellbore annulus with a stage tool, the method comprising:

deploying a stage tool on the casing in the wellbore, the stage tool having an exit port with a first obstruction exposed to an internal bore of the stage tool and having a closing sleeve in an initial position in the internal bore leaving the first obstruction exposed unbreached to an initial pressure component in the internal bore during run-in and initial operation of the stage tool;

breaching the first obstruction of the exit port of the stage tool by applying a first fluid pressure component in the stage tool;

communicating cement slurry from the open exit port to the wellbore annulus; and failing to close a closing sleeve on the stage tool from the initial position to a closed position relative to the exit port in response to a second fluid pressure component, the closing sleeve in the closed position configured to sealably cover the first breached obstruction from the internal bore and prevent fluid communication through the exit port; and installing an insert separate from the stage tool at least partially in the stage tool to prevent fluid communication through the exit port in response to the failed closing of the closing sleeve on the stage tool relative to the exit port.

27. The method of claim 26, wherein failing to close the closing sleeve on the stage tool relative to the exit port in response to the second fluid pressure component comprises failing to seat a closure plug on a seat in the closing sleeve.

28. The method of claim 26, wherein failing to close the closing sleeve on the stage tool relative to the exit port in response to the second fluid pressure component comprises failing to activate a closure mechanism on the stage tool.

29. The method of claim 26, wherein installing the insert comprises sealing an external seal disposed about an external surface of the insert in the stage tool.

30. The method of claim 29, wherein sealing the external seal disposed about the external surface of the insert in the stage tool comprises covering existing seals and joints in the tool with the external surface and the external seal.

31. The method of claim 29, wherein the external seal is composed of an elastomer or a swellable material.

32. The method of claim 26, wherein failing to close the closing sleeve on the stage tool relative to the exit port in response to the second fluid pressure component comprises:

seating a closure plug on a seat in the closing sleeve; and failing to move the closing sleeve closed by applying the second fluid pressure component against the seated plug.

33. The method of claim 26, wherein failing to close the closing sleeve on the stage tool relative to the exit port in response to the second fluid pressure component comprises:

activating a closure mechanism on the stage tool; and failing to move the closing sleeve closed with the activated closure mechanism using the second fluid pressure component.

* * * * *